US010024080B2

(12) United States Patent
Marsden

(10) Patent No.: US 10,024,080 B2
(45) Date of Patent: Jul. 17, 2018

(54) SAFETY GATE

(71) Applicant: Elbee Pty Ltd., Bondi Junction (AU)

(72) Inventor: Andrew Marsden, Hingham, MA (US)

(73) Assignee: Elbee Pty Ltd., Bondi Junction (AU)

( * ) Notice: Subject to any disclaimer, the term of this patent is extended or adjusted under 35 U.S.C. 154(b) by 0 days.

(21) Appl. No.: 15/255,049

(22) Filed: Sep. 1, 2016

(65) Prior Publication Data

US 2017/0058595 A1 Mar. 2, 2017

Related U.S. Application Data

(60) Provisional application No. 62/213,313, filed on Sep. 2, 2015.

(51) Int. Cl.

| | |
|---|---|
| ***E05B 41/00*** | (2006.01) |
| ***E06B 9/04*** | (2006.01) |
| ***E05B 65/00*** | (2006.01) |
| *E06B 9/00* | (2006.01) |

(52) U.S. Cl.

CPC ..... *E05B 41/00* (2013.01); *E05B 65/0007* (2013.01); *E06B 9/04* (2013.01); *E05B 65/0014* (2013.01); *E06B 2009/002* (2013.01)

(58) Field of Classification Search

CPC .. E05B 65/0007; E05B 65/0014; E05B 41/00; E06B 2009/002; E06B 9/04; E06B 9/02

See application file for complete search history.

(56) References Cited

U.S. PATENT DOCUMENTS

| | | | | |
|---|---|---|---|---|
| 4,083,591 | A | 4/1978 | Parisien | |
| 2004/0045222 | A1* | 3/2004 | Hicks | E05F 1/066 49/394 |
| 2007/0131921 | A1* | 6/2007 | Monahan | E06B 9/04 256/73 |
| 2008/0191497 | A1* | 8/2008 | Mayo | E05B 65/0007 292/169 |
| 2012/0011775 | A1* | 1/2012 | Chen | E05B 47/004 49/358 |
| 2012/0055092 | A1* | 3/2012 | Boucquey | E05B 65/0007 49/192 |
| 2012/0255234 | A1* | 10/2012 | Wang | E05B 65/0007 49/395 |
| 2014/0007506 | A1 | 1/2014 | Huang | |
| 2015/0101250 | A1 | 4/2015 | Marsden | |
| 2015/0101253 | A1 | 4/2015 | Marsden et al. | |
| 2017/0058594 | A1* | 3/2017 | Marsden | E05D 11/1007 |

OTHER PUBLICATIONS

International Search Report and Written Opinion for Application No. PCT/AU2016/000310, dated Dec. 15, 2016.

* cited by examiner

*Primary Examiner* — Justin B Rephann

(74) *Attorney, Agent, or Firm* — Wolf, Greenfield & Sacks, P.C.

(57) ABSTRACT

A safety gate is provided with one or more of a curved path for holding a pressure mount to prevent unlocking, and a color-coded locked/unlocked status indicator for use in openings, such as doorways, to provide a barrier for a small child or for any other suitable use. The changing of the colors, from, for example, red to green indicates to a user that the gate is locked (green) or unlocked (red). The door opening mechanisms may allow the door to be unlocked or locked with one hand.

13 Claims, 29 Drawing Sheets

SAFETY GATE

RELATED APPLICATIONS

This Application claims priority under 35 U.S.C. § 119(e) to U.S. Provisional Application Ser. No. 62/213,313, entitled "PUZZLE GATE", and filed on Sep. 2, 2015, which is herein incorporated by reference in its entirety.

FIELD

Embodiments herein relate generally to a safety gate, and more specifically to safety gates which include one or more rounded edges to limit injury, a curved path for holding a pressure mount to prevent unlocking, and a highly visible, color-coded locked/unlocked status indicator for use in household openings, such as doorways, to provide a barrier for a small child, or for any other suitable use.

DISCUSSION OF THE RELATED ART

Safety gates are used throughout households to prevent babies, children, and pets from accessing unsafe areas, such as landings, stairs, or non-childproofed furniture or rooms.

One disadvantage of some safety gates is the requirement of two hands to open and close the gate. While such an arrangement prevents unwanted openings from children, it also hinders adults that are often carrying children or household items in one of their hands.

Another disadvantage of some safety gates is the uncertainty of knowing from a distance whether the gate is locked or not. Adults and older children, will sometimes accidentally close, but not lock, a toddler safety gate. Without the locking mechanism engaged, a toddler or small child may open the gate and access unsafe areas.

SUMMARY

Embodiments disclosed herein address these disadvantages by providing a safety gate that may be easily opened and closed with one hand, and/or has a highly visible, color-coded status indicator that shows someone within visual range whether the gate is properly locked.

Additional features are described herein. In this respect, before explaining at least one embodiment in detail, it is to be understood that the invention is not limited in its application to the details of construction and to the arrangements of the components set forth in the following description or illustrated in the drawings. Other embodiments may be practiced in various manners.

According to one embodiment, a safety gate includes a first panel including a top mount extending from the panel, with the top mount having an end. The gate also includes a first top side brace mount, the first top side brace mount having a sidewalls forming a first channel into which the top mount end fits. The first channel has first and second side openings through which the top mount end can exit. The gate also has a top extended surface that, with the sidewalls of the first top side brace mount, prevents the top mount end from being released from the top side brace mount except through the first and second side openings of the first channel.

According to another embodiment, a safety gate includes a first panel including a top mount extending from the panel, with the top mount having an end. The gate includes a first top side brace mount, the first top side brace mount having a sidewalls forming a first channel into which the top mount end fits, wherein a depressible member is positioned within the channel. A visual status indicator is included and has a surface having first and second distinct colors. The first top side brace mount has an opening through which the surface of the visual status indicator is visible. When the gate is closed by placing the end of the top mount into the catch, the pressure of the top mount on the depressible member lowers an internal lever which lowers the surface of the visual status indicator such that the first color of the surface is substantially aligned with the opening of the first top side brace mount. When the gate is in an open position, the second color of the surface is substantially aligned with the opening of the first top side brace mount.

In one embodiment, an expandable gate assembly is arranged for positioning within an opening through which selective access is required. The gate assembly may include: two panels slidably mounted to each other via a top bracket and a bottom bracket to allow adjustment of the gate assembly's overall width, and to allow the fitting of said gate assembly into said opening. The gate may also include a first set of mounting braces, each comprising a substantially flat rear surface, and a front surface for attaching to two elongated fixed mounting members; and a third mounting brace comprising a front recess enclosed by a sidewall, wherein the sidewall has at least one opening proximate to the top of the third mounting brace. The gate may also include a first elongated moveable mounting member comprising a first end contained within the second panel, and a second end comprising a substantially flat head extending outwardly from the third elongated mounting member, wherein the flat head fits within the side opening to be contained within the sidewall of the recess; and a fourth mounting brace comprising a front serpentine recess enclosed by a sidewall. The sidewall may have at least one side opening proximate to the top of the fourth mounting brace, a second elongated moveable mounting member comprising a first end contained within the second panel, and a second end comprising a substantially flat head extending outwardly from the fourth elongated mounting member. The flat head fits within the side opening to be contained within the sidewall of the serpentine recess, wherein an end of the serpentine channel comprises a catch for removably receiving the substantially flat head. A visual indicator operatively engaged with the catch also may be included, wherein the visual indicator permits the nearby observer to view a first color when the catch is disengaged. Upon engagement of the substantially flat head with the catch, the visual indicator permits the nearby observer to view a second color through the opening.

Another embodiment includes an expandable gate assembly arranged for positioning in an opening through which selective access is required in use. The gate assembly may include two panels slidably mounted to each other via a top bracket and a bottom bracket to allow adjustment of the gate assembly's overall width to allow fitting of said gate assembly in said opening. The assembly may further include a first set of mounting braces, each comprising a substantially flat rear surface, and a front surface for attaching to two elongated fixed mounting members. The assembly also may include a third mounting brace comprising a front recess enclosed by a sidewall, wherein the sidewall has at least one opening proximate to the top of the third mounting brace, a first elongated moveable mounting member comprising a first end contained within the second panel, and a second end comprising a substantially flat head extending outwardly from the third elongated mounting member. The flat head fits within the side opening to be contained within the sidewall of the recess. A fourth mounting brace comprising a front serpentine recess enclosed by a sidewall may be included, wherein the sidewall has at least one side opening proximate to the top of the fourth mounting brace, a second elongated moveable mounting member comprising a first end contained within the second panel, and a second end comprising a substantially flat head extending outwardly from the fourth elongated mounting member. The flat head may fit within the side opening to be contained within the sidewall of the serpentine recess, and an end of the serpentine channel may comprise a catch for removably receiving the substantially flat head.

Another embodiment includes an expandable gate assembly arranged for positioning in an opening through which selective access is required. The gate assembly may include: two panels slidably mounted to each other via a top bracket and a bottom bracket to allow adjustment of the gate assembly's overall width to allow fitting of said gate assembly in said opening. The gate assembly may further include a first mounting brace and a second mounting brace, wherein the first and second mounting braces each comprise a housing with a substantially flat rear surface, and a front surface having a substantially cylindrical member. The rear surfaces of the first and second mounting braces are attached to a framing of said opening in substantial alignment. A first elongated mounting member comprises a first end contained within the first panel, and a second end comprising a curved catch attached about the substantially cylindrical member of the first mounting brace. A second elongated mounting member comprises a first end contained within the first panel, and a second end comprising a curved catch attached about the substantially cylindrical member of the second mounting brace. A third mounting brace comprises a housing with a substantially flat rear surface and a front surface having channel, wherein the channel comprises a vertical sidewall. The sidewall may have two parallel side openings proximate to the top of the front surface, a third elongated mounting member comprising a first end contained within the second panel, and a second end comprising a substantially flat head extending outwardly from the third elongated mounting member. The flat head fits within either parallel side opening into the channel. A fourth mounting brace comprises a housing with a substantially flat rear surface and a front surface having serpentine channel, wherein the serpentine channel comprises a vertical sidewall, and the sidewall has two parallel side openings proximate to the top of the front surface. A fourth elongated mounting member comprises a first end contained within the second panel, and a second end comprising a substantially flat head extending outwardly from the fourth elongated mounting member, wherein the flat head fits within either parallel side opening into the serpentine channel An end of the serpentine channel comprises a catch for removably receiving the substantially flat head, wherein the rear surfaces of the third mounting brace and the fourth mounting brace are attached to a framing of said opening in substantial alignment.

Another embodiment includes an expandable gate assembly arranged for positioning in an opening through which selective access is required in use. The gate assembly includes: two panels telescoping mounted to each other via a top bracket and a bottom bracket to allow adjustment of the gate assembly's overall width to allow fitting of said gate assembly in said opening. The gate may further include a first set of mounting braces, each comprising a substantially flat rear surface, and a front surface with a substantially cylindrical member. Two elongated fixed mounting members may be included, each comprising a first end contained within the first panel, and a second curved end for attaching to the substantially cylindrical members of the first set of mounting braces. The assembly may include a third mounting brace comprising a substantially flat rear surface and a front surface having a channel enclosed by a vertical sidewall, wherein the sidewall has at least one side opening proximate to the top of the front surface. A first elongated moveable mounting member comprising a first end contained within the second panel may be included, and a second end comprising a substantially flat head extending outwardly from the third elongated mounting member, wherein the flat head fits within the parallel side opening to be contained within the vertical sidewalls of the channel. A fourth mounting brace may be included comprising a substantially flat rear surface and a front surface having a serpentine channel enclosed by a vertical sidewall, wherein the sidewall has at least one side opening proximate to the top of the front surface, a second elongated moveable mounting member comprising a first end contained within the second panel, and a second end comprising a substantially flat head extending outwardly from the fourth elongated mounting member. The flat head fits within the side opening to be contained within the vertical sidewalls of the serpentine channel, wherein an end of the serpentine channel comprises a catch for removably receiving the substantially flat head.

Another embodiment includes an expandable gate assembly arranged for positioning in an opening through which selective access is required. The gate assembly includes: two panels slidably mounted to each other via a top bracket and a bottom bracket to allow adjustment of the gate assembly's overall width to allow fitting of said gate assembly in said opening. The assembly may include a first set of mounting braces, each comprising a substantially flat rear surface, and a front surface with a substantially cylindrical member. Also included may be two elongated fixed mounting members, each comprising a first end contained within the first panel, and a second curved end for attaching to the substantially cylindrical members of the first set of mounting braces. The assembly may further include a third mounting brace comprising a substantially flat rear surface and a front surface having channel enclosed by a vertical sidewall, wherein the sidewall has at least one side opening proximate to the top of the front surface. Also included may be a first elongated moveable mounting member comprising a first end contained within the second panel, and a second end comprising a substantially flat head extending outwardly from the third elongated mounting member, wherein the flat head fits within the parallel side opening to be contained within the vertical sidewalls of the channel. A fourth mounting brace comprising a substantially flat rear surface and a front surface having a serpentine channel enclosed by a vertical sidewall may be included, wherein the sidewall has at least one side opening proximate to the top of the front surface, a second elongated moveable mounting member comprising a first end contained within the second panel, and a second end comprising a substantially flat head extending outwardly from the fourth elongated mounting member. The flat head fits within the side opening to be contained within the vertical sidewalls of the serpentine channel, wherein an end of the serpentine channel comprises a catch for removably receiving the substantially flat head. A visual indicator may be operatively engaged with the catch, wherein the visual indicator is visible to a nearby observer through an opening on the fourth mounting brace. In some embodiments, before engagement of the flat head of the fourth elongated member with the catch, the visual indicator permits the nearby observer to view a first color through the opening on the fourth mounting brace, and upon engagement of the substantially flat head with the catch, the visual indicator permits the nearby observer to view a second color through the opening.

Another embodiment includes an expandable gate assembly arranged for positioning in an opening through which selective access is required in use. The gate assembly includes two panels slidably mounted to each other via a top bracket and a bottom bracket to allow adjustment of an overall width of the gate assembly to allow fitting of the gate assembly in the opening. The assembly also may include a first set of mounting braces, each comprising a substantially flat rear surface, and a front surface with a substantially cylindrical member. Two elongated fixed mounting members may be included, each comprising a first end contained within the first panel, and a second curved end for attaching to the substantially cylindrical members of the first set of mounting braces. The assembly may include a third mounting brace comprising a housing with a substantially flat rear surface and a front surface having channel, wherein the channel comprises a vertical sidewall, and the sidewall has two parallel side openings proximate to the top of the front surface. A third elongated mounting member may comprise a first end contained within the second panel, and a second end comprising a substantially flat head extending outwardly from the third elongated mounting member. The flat head may fit within either parallel side opening into the channel. A fourth mounting brace comprising a housing with a substantially flat rear surface and a front surface has a serpentine channel, wherein the serpentine channel comprises a vertical sidewall. The sidewall has two parallel side openings proximate to the top of the front surface. A fourth elongated mounting member may include a first end contained within the second panel, and a second end comprising a substantially flat head extending outwardly from the fourth elongated mounting member. The flat head fits within either parallel side opening into the serpentine channel, and an end of the serpentine channel comprises a catch for removably receiving the substantially flat head. The rear surfaces of the third mounting brace and the fourth mounting brace may be attached to a framing of said opening in substantial alignment. An internal level and internal visual indicator may be operatively engaged with the catch within the fourth mounting brace, wherein the internal visual indicator comprises a first color and a second color visible through an opening on the fourth mounting brace. Before engagement of the flat head of the fourth elongated member with the catch, the visual indicator permits a nearby observer to view the first color through the opening on the fourth mounting brace. Upon engagement of the substantially flat head with the catch, the lever engages the visual indicator to permit the nearby observer to view the second color through the opening.

Another embodiment includes an expandable gate assembly arranged for positioning in an opening through which selective access is required in use. The gate assembly includes two panels telescoping mounted to each other via a top bracket and a bottom bracket to allow adjustment of an overall width of the gate assembly to allow fitting of said gate assembly in the opening. The assembly may include a first set of mounting braces, each comprising a substantially flat rear surface, and a front surface with a substantially cylindrical member. The assembly may further include two elongated fixed mounting members, each comprising a first end contained within the first panel, and a second curved end for attaching to the substantially cylindrical members of the first set of mounting braces. A third mounting brace may be included and comprise a housing with a substantially flat rear surface and a front surface having channel, wherein the channel comprises a vertical sidewall, and the sidewall has two parallel side openings proximate to the top of the front surface. A third elongated mounting member may be included and comprise a first end contained within the second panel, and a second end comprising a substantially flat head extending outwardly from the third elongated mounting member, wherein the flat head fits within either parallel side opening into the channel. A fourth mounting brace may be included and comprise a housing with a substantially flat rear surface and a front surface having serpentine channel, wherein the serpentine channel comprises a vertical sidewall. The sidewall may have two parallel side openings proximate to the top of the front surface. A fourth elongated mounting member may be included and comprise a first end contained within the second panel, and a second end comprising a substantially flat head extending outwardly from the fourth elongated mounting member, wherein the flat head fits within either parallel side opening into the serpentine channel. An end of the serpentine channel may comprise a catch for removably receiving the substantially flat head. In some embodiments, the rear surfaces of the third mounting brace and the fourth mounting brace are attached to a framing of said opening in substantial alignment. An internal level and internal visual indicator may be operatively engaged with the catch within the fourth mounting brace, wherein the internal visual indicator comprises a first color and a second color visible through an opening on the fourth mounting brace. Before engagement of the flat head of the fourth elongated member with the catch, the visual indicator permits a nearby observer to view the first color through the opening on the fourth mounting brace. Upon engagement of the substantially flat head with the catch, the lever engages the visual indicator to permit the nearby observer to view the second color through the opening.

Another embodiment includes an expandable gate assembly arranged for positioning in an opening through which selective access is required in use. The gate assembly includes: a first panel with a first member slidably adjacently mounted to a first member of a second panel with a first bracket, a second member on the first panel slidably adjacently mounted to a second member of the second panel with a second bracket, wherein the first and second brackets to allow adjustment of the gate assembly's overall width to allow fitting of said gate assembly in said opening: a first set of mounting braces, each comprising a substantially flat rear surface, and a front surface with a substantially cylindrical member; two elongated fixed mounting members, each comprising a first end contained within the first panel, and a second curved end for attaching to the substantially cylindrical members of the first set of mounting braces; a third mounting brace comprising a housing with a substantially flat rear surface and a front surface having channel, wherein the channel comprises a vertical sidewall, wherein the sidewall has only two parallel side openings proximate to the top of the front surface, a third elongated mounting member comprising a first end contained within the second panel, and a second end comprising a substantially flat head extending outwardly from the third elongated mounting member, wherein the flat head fits within either parallel side opening into the channel; a fourth mounting brace comprising a housing with a substantially flat rear surface and a front surface having serpentine channel, wherein the serpentine channel comprises a vertical sidewall, wherein the sidewall has only two parallel side openings proximate to the top of the front surface, a fourth elongated mounting member comprising a first end contained within the second panel, and a second end comprising a substantially flat head extending outwardly from the fourth elongated mounting member, wherein the flat head fits within either parallel side opening into the serpentine channel, wherein an end of the serpentine channel comprises a catch for removably receiving the substantially flat head; wherein the rear surfaces of the third mounting brace and the fourth mounting brace are attached to a framing of said opening in substantial alignment; an internal level and internal visual indicator operatively engaged with the catch within the fourth mounting brace, wherein the internal visual indicator comprises a first color and a second color visible through an opening on the fourth mounting brace, wherein before engagement of the flat head of the fourth elongated member with the catch, the visual indicator permits a nearby observer to view only the first color through the opening on the fourth mounting brace, further wherein upon engagement of the substantially flat head with the catch, the lever engages the visual indicator to permit the nearby observer to view only the second color through the opening.

Another embodiment includes an expandable gate assembly arranged for positioning in an opening through which selective access is required in use. Said gate assembly includes: two panels slidably mounted to each other via a top bracket and a bottom bracket to allow adjustment of the gate assembly's overall width to allow fitting of said gate assembly in said opening: a first mounting brace and a second mounting brace, wherein the first and second mounting braces each comprise a housing with a substantially flat rear surface, and a front surface having a substantially cylindrical member, wherein the rear surfaces of the first and second mounting braces are attached to a framing of said opening in substantial alignment; a first elongated mounting member comprising a first end contained within the first panel, and a second end comprising a curved catch attached about the substantially cylindrical member of the first mounting brace: a second elongated mounting member comprising a first end contained within the first panel, and a second end comprising a curved catch attached about the substantially cylindrical member of the second mounting brace; a third mounting brace comprising a housing with a substantially flat rear surface and a front surface having channel, wherein the channel comprises a vertical sidewall, wherein the sidewall has only two parallel side openings proximate to the top of the front surface, a third elongated mounting member comprising a first end contained within the second panel, and a second end comprising a substantially flat head extending outwardly from the third elongated mounting member, wherein the flat head fits within either parallel side opening into the channel; a fourth mounting brace comprising a housing with a substantially flat rear surface and a front surface having serpentine channel, wherein the serpentine channel comprises a vertical sidewall, wherein the sidewall has only two parallel side openings proximate to the top of the front surface, a fourth elongated mounting member comprising a first end contained within the second panel, and a second end comprising a substantially flat head extending outwardly from the fourth elongated mounting member, wherein the flat head fits within either parallel side opening into the serpentine channel, wherein an end of the serpentine channel comprises a catch for removably receiving the substantially flat head; wherein the rear surfaces of the third mounting brace and the fourth mounting brace are attached to a framing of said opening in substantial alignment; an internal level and internal visual indicator operatively engaged with the catch within the fourth mounting brace, wherein the internal visual indicator comprises a first color and a second color visible through an opening on the fourth mounting brace, wherein before engagement of the flat head on the fourth elongated member with the catch, the visual indicator permits a nearby observer to view only the first color through the opening on the fourth mounting brace, further wherein upon engagement of the substantially flat head with the catch, the lever engages the visual indicator to permit the nearby observer to view only the second color through the opening.

Another embodiment includes an expandable gate assembly arranged for positioning in an opening through which selective access is required in use. Said gate assembly includes: two telescoping panels mounted to each other via a top bracket and a bottom bracket to allow adjustment of the gate assembly's overall width to allow fitting of said gate assembly in said opening: a first mounting brace and a second mounting brace, wherein the first and second mounting braces each comprise a housing with a substantially flat rear surface, and a front surface having a substantially cylindrical member, wherein the rear surfaces of the first and second mounting braces are attached to a framing of said opening in substantial alignment; a first elongated mounting member comprising a first end contained within the first panel, and a second end comprising a curved catch attached about the substantially cylindrical member of the first mounting brace: a second elongated mounting member comprising a first end contained within the first panel, and a second end comprising a curved catch attached about the substantially cylindrical member of the second mounting brace; a third mounting brace comprising a housing with a substantially flat rear surface and a front surface having channel, wherein the channel comprises a vertical sidewall, wherein the sidewall has only two parallel side openings proximate to the top of the front surface, a third elongated mounting member comprising a first end contained within the second panel, and a second end comprising a substantially flat head extending outwardly from the third elongated mounting member, wherein the flat head fits within either parallel side opening into the channel; a fourth mounting brace comprising a housing with a substantially flat rear surface and a front surface having serpentine channel, wherein the serpentine channel comprises a vertical sidewall, wherein the sidewall has only two parallel side openings proximate to the top of the front surface, a fourth elongated mounting member comprising a first end contained within the second panel, and a second end comprising a substantially flat head extending outwardly from the fourth elongated mounting member, wherein the flat head fits within either parallel side opening into the serpentine channel, wherein an end of the serpentine channel comprises a catch for removably receiving the substantially flat head; wherein the rear surfaces of the third mounting brace and the fourth mounting brace are attached to a framing of said opening in substantial alignment; an internal level and internal visual indicator operatively engaged with the catch within the fourth mounting brace, wherein the internal visual indicator comprises a first color and a second color visible through an opening on the fourth mounting brace, wherein before engagement of the flat head of the fourth elongated member with the catch, the visual indicator permits a nearby observer to view only the first color through the opening on the fourth mounting brace, further wherein upon engagement of the substantially flat head with the catch, the lever engages the visual indicator to permit the nearby observer to view only the second color through the opening.

Another embodiment includes an expandable gate assembly arranged for positioning in an opening through which selective access is required in use. Said gate assembly includes: a first panel with a first member slidably adjacently mounted to a first member of a second panel with a first bracket, a second member on the first panel slidably adjacently mounted to a second member of the second panel with a second bracket, wherein the first and second brackets to allow adjustment of the gate assembly's overall width to allow fitting of said gate assembly in said opening: a first mounting brace and a second mounting brace, wherein the first and second mounting braces each comprise a housing with a substantially flat rear surface, and a front surface having a substantially cylindrical member, wherein the rear surfaces of the first and second mounting braces are attached to a framing of said opening in substantial alignment; a first elongated mounting member comprising a first end contained within the first panel, and a second end comprising a curved catch attached about the substantially cylindrical member of the first mounting brace: a second elongated mounting member comprising a first end contained within the first panel, and a second end comprising a curved catch attached about the substantially cylindrical member of the second mounting brace; a third mounting brace comprising a housing with a substantially flat rear surface and a front surface having channel, wherein the channel comprises a vertical sidewall, wherein the sidewall has only two parallel side openings proximate to the top of the front surface, a third elongated mounting member comprising a first end contained within the second panel, and a second end comprising a substantially flat head extending outwardly from the third elongated mounting member, wherein the flat head fits within either parallel side opening into the channel; a fourth mounting brace comprising a housing with a substantially flat rear surface and a front surface having serpentine channel, wherein the serpentine channel comprises a vertical sidewall, wherein the sidewall has only two parallel side openings proximate to the top of the front surface, a fourth elongated mounting member comprising a first end contained within the second panel, and a second end comprising a substantially flat head extending outwardly from the fourth elongated mounting member, wherein the flat head fits within either parallel side opening into the serpentine channel, wherein an end of the serpentine channel comprises a catch for removably receiving the substantially flat head; wherein the rear surfaces of the third mounting brace and the fourth mounting brace are attached to a framing of said opening in substantial alignment; an internal level and internal visual indicator operatively engaged with the catch within the fourth mounting brace, wherein the internal visual indicator comprises a first color and a second color visible through an opening on the fourth mounting brace, wherein before engagement of the flat head of the fourth elongated member with the catch, the visual indicator permits a nearby observer to view only the first color through the opening on the fourth mounting brace, further wherein upon engagement of the substantially flat head with the catch, the lever engages the visual indicator to permit the nearby observer to view only the second color through the opening.

In some embodiments of the subject invention, the substantially flat head is a 20 mm by 4 MM flat head.

In some embodiments of the subject invention, the mounting braces comprise adhesive on rear surfaces for attachment to the opening frame.

In some embodiments of the subject invention, the mounting braces comprise at least one threaded hole for receiving set screws for the opening frame.

In some other embodiments of the subject invention, the first color is green and the second color is red.

In some embodiments of the subject invention, the term "substantially" is defined as at least close to (and can include) a given value or state, as understood by a person of ordinary skill in the art. In one embodiment, the term "substantially" refers to ranges within 10%, preferably within 5%, more preferably within 1%, and most preferably within 0.1% of the given value or state being specified.

In embodiments of the subject invention, the term "relatively" is defined as a comparison of a property, or the proportion of a property between two components, the property herein being the deformability between the apex and the legs of the clip.

There has thus been outlined, rather broadly, the more important features of the embodiments of the safety gate. There are additional features of the invention that will be described hereinafter.

BRIEF DESCRIPTION OF DRAWINGS

Advantages will be apparent from the following detailed description of embodiments of the safety gate. Said descriptions should be considered in conjunction with the accompanying drawings, in which.

DETAILED DESCRIPTION

Figure 1:
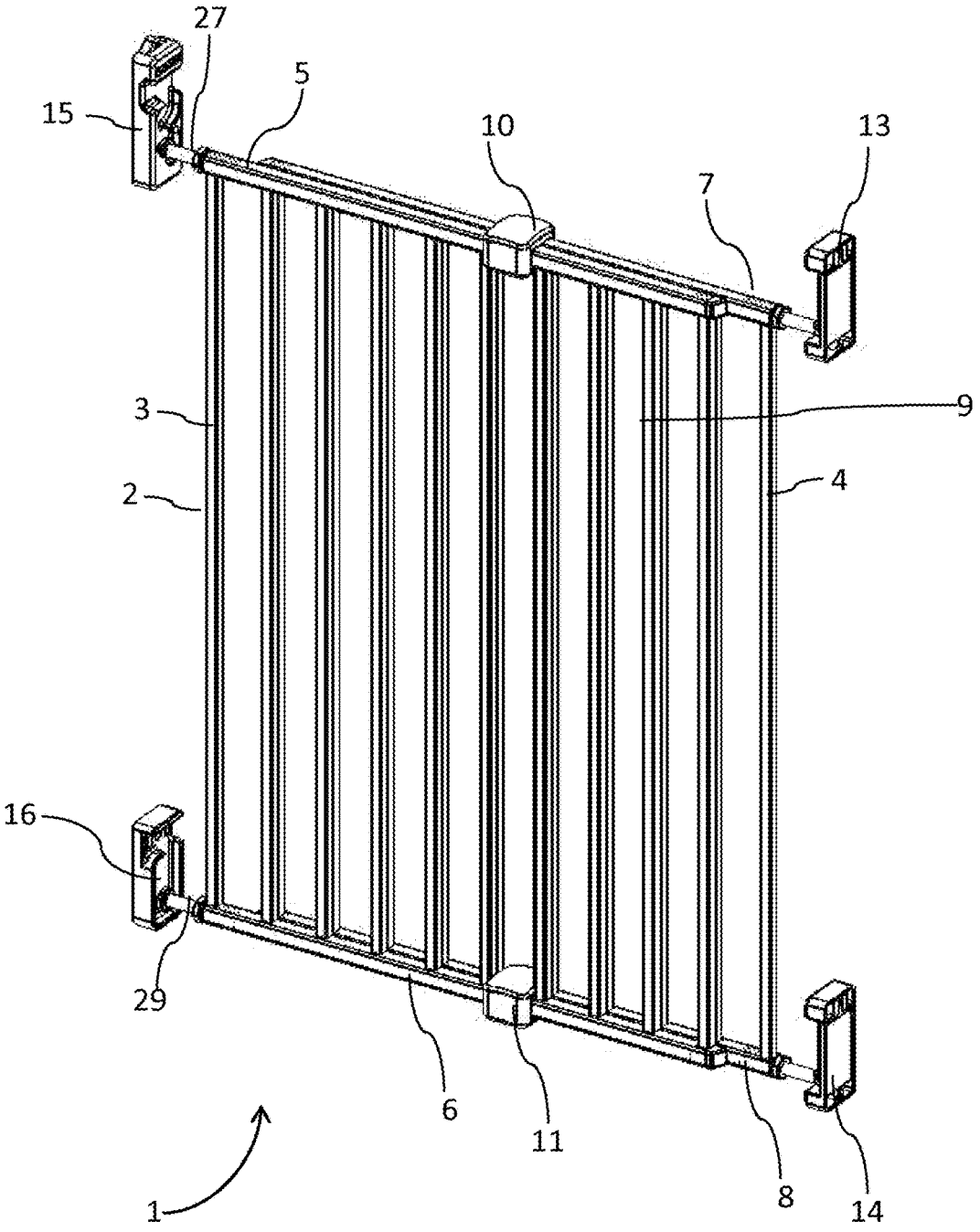
FIG. 1 is an isometric view of a gate according to one embodiment.
Figure 2:
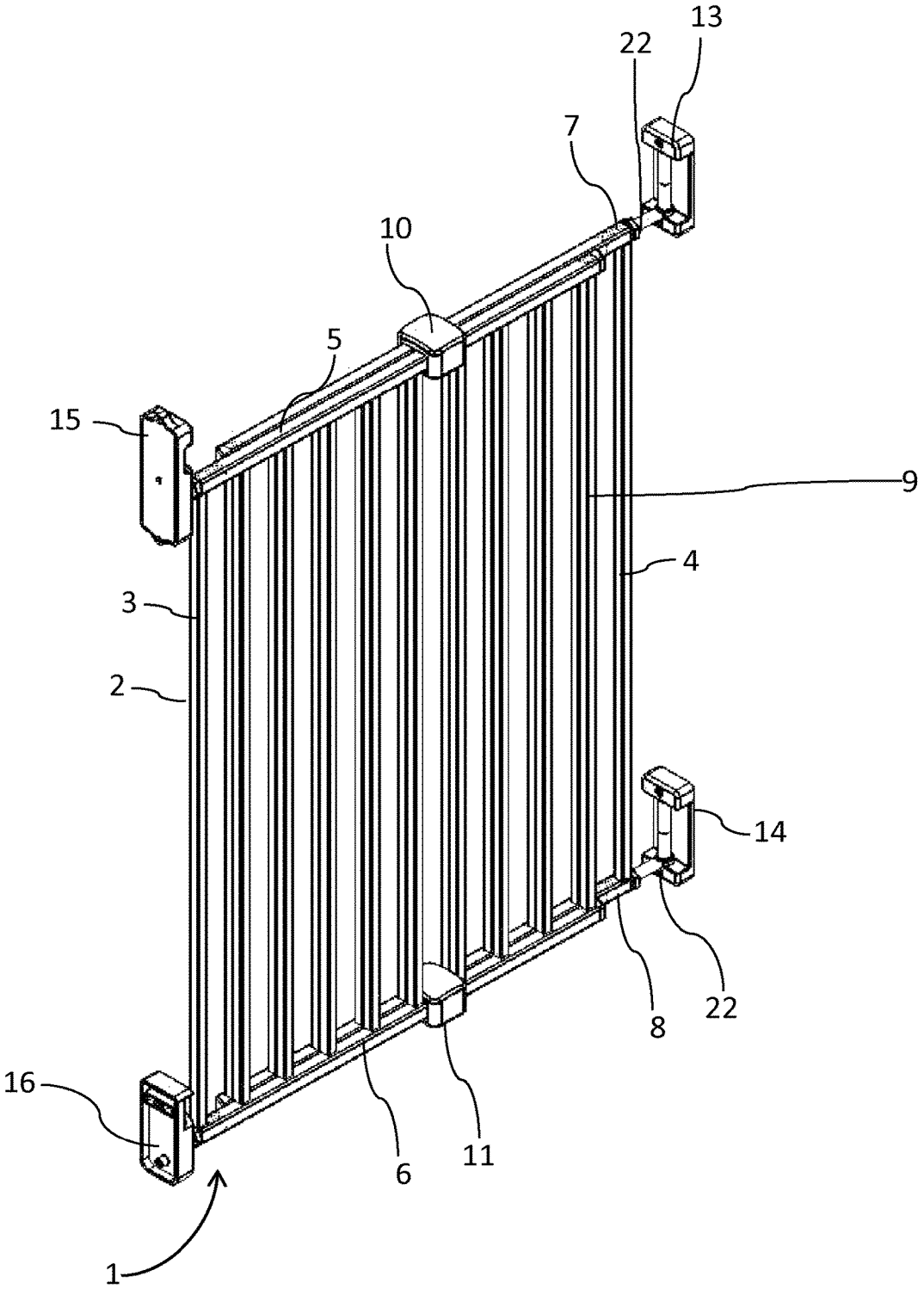
FIG. 2 is another isometric view of the gate.
Figure 3:
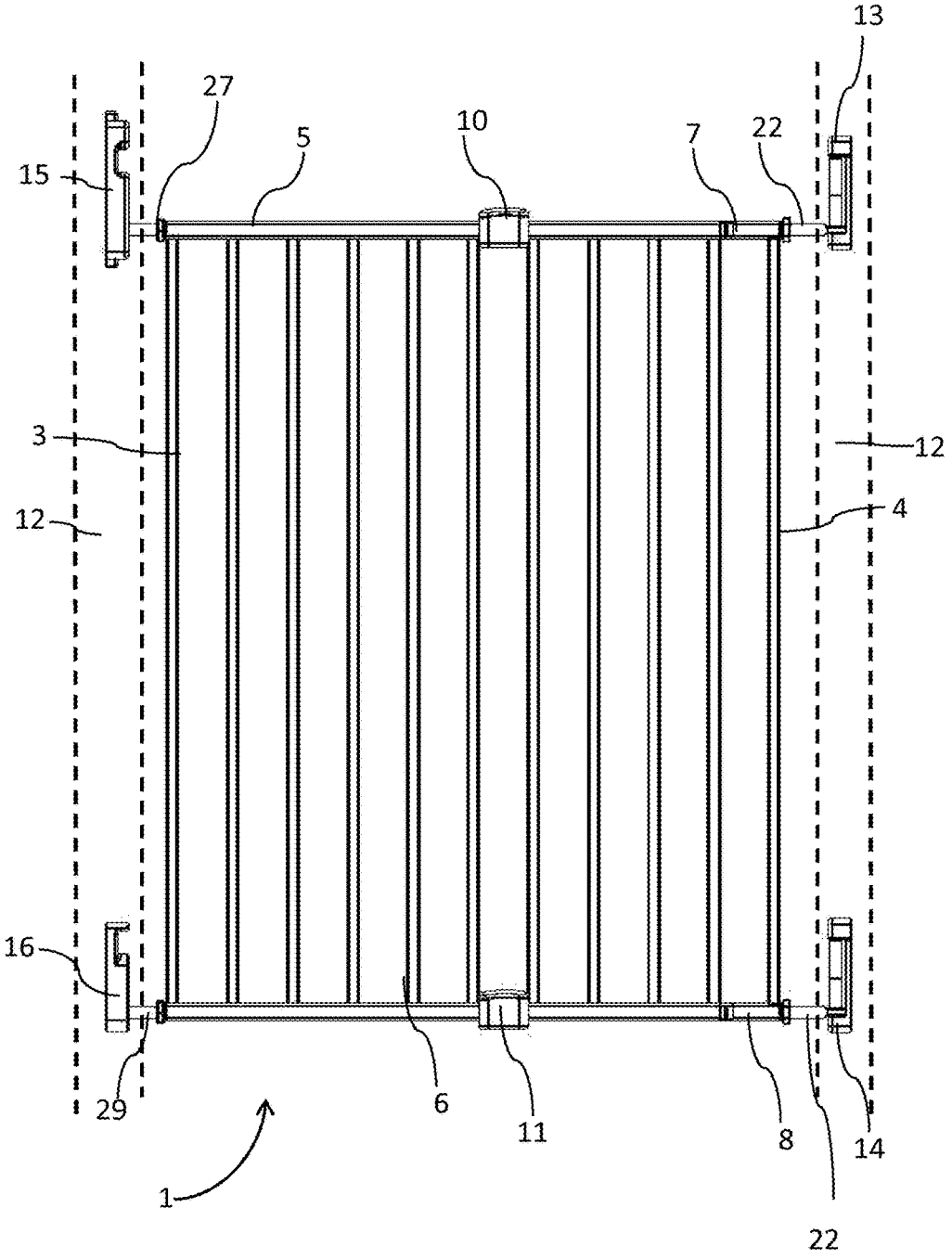
FIG. 3 is a front view of the gate pressure mounted to a doorway.
Figure 4:
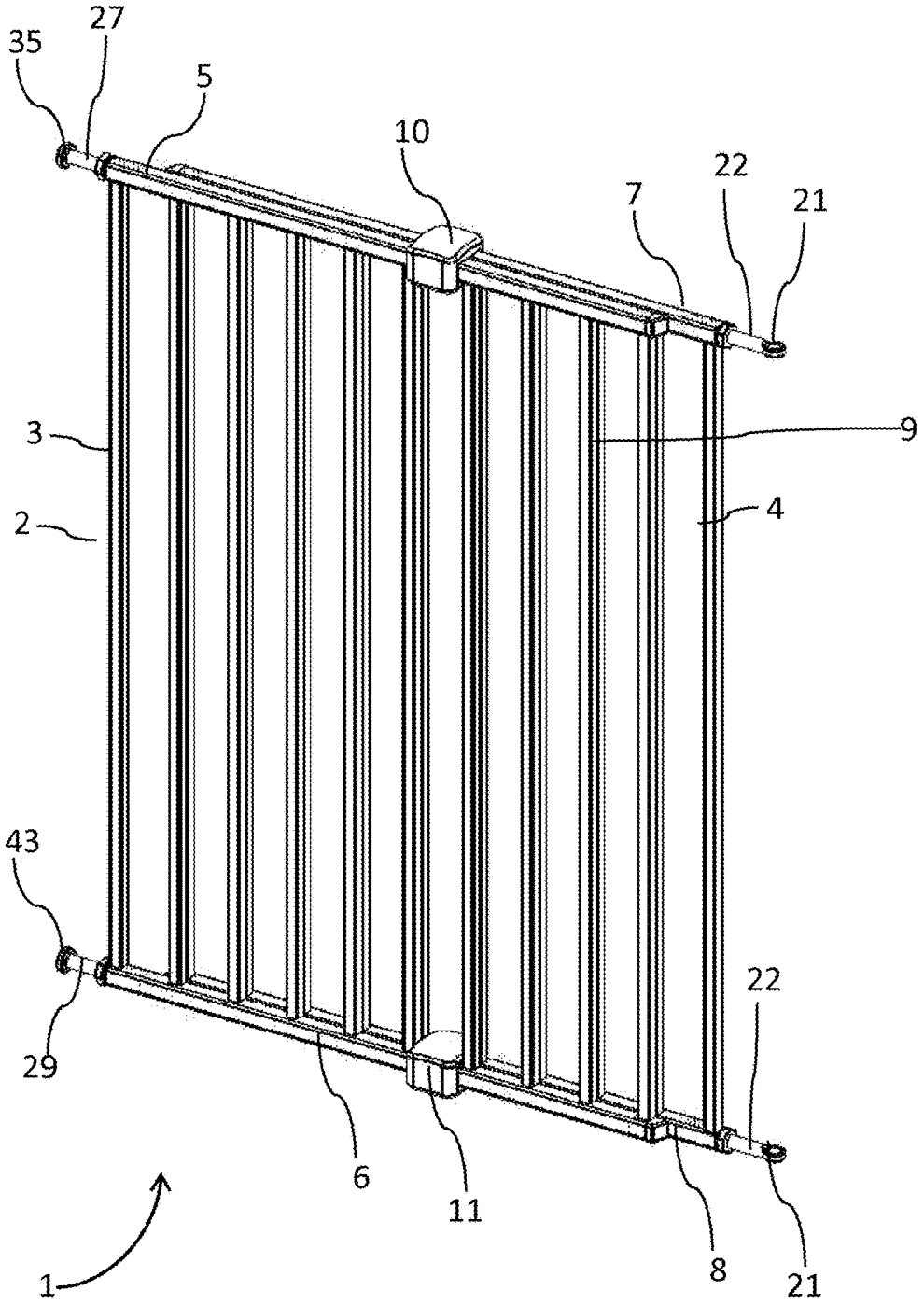
FIG. 4 is an isometric view of the gate without doorway braces.
Figure 5:
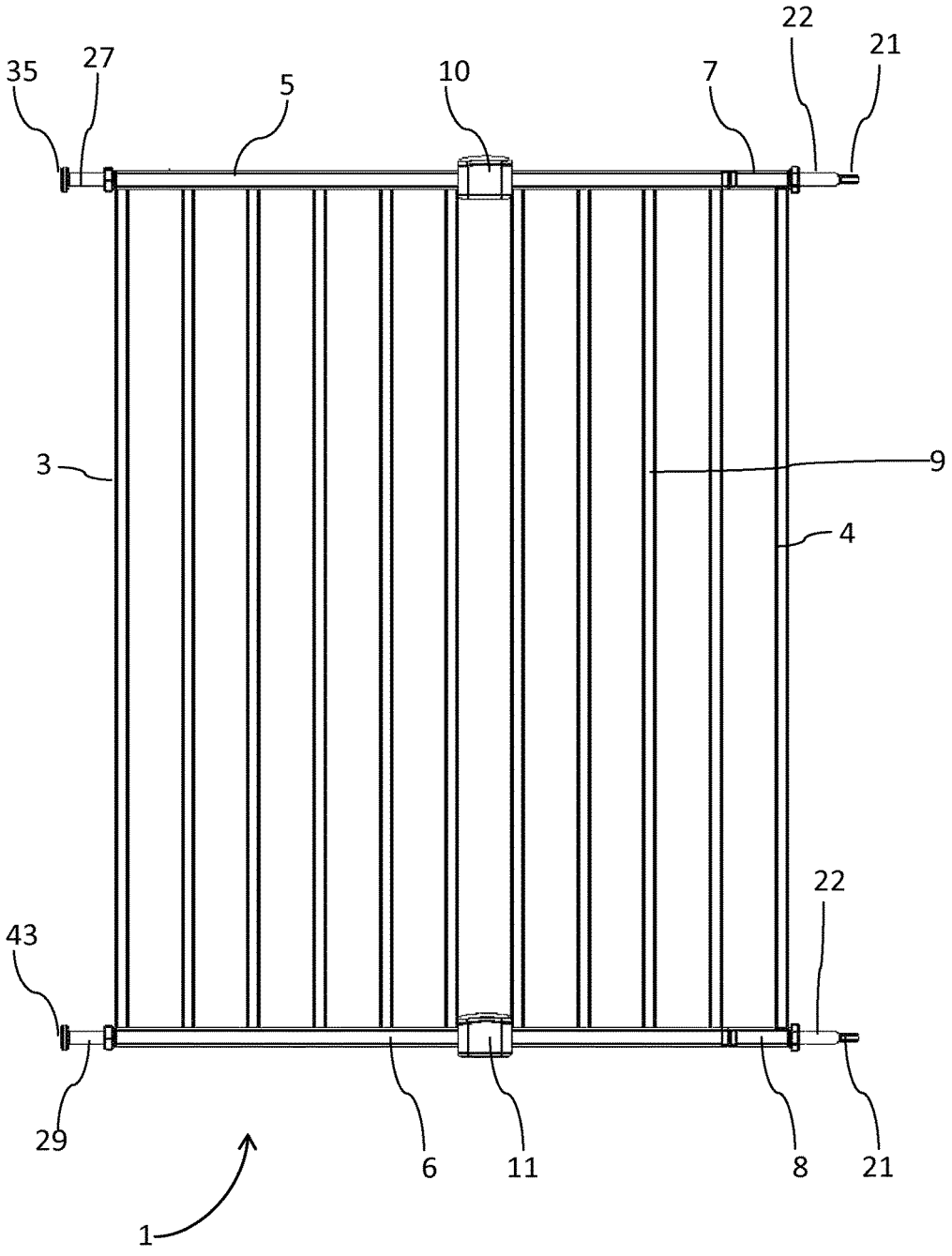
FIG. 5 is a front view of the gate without doorway braces.
Figure 6:
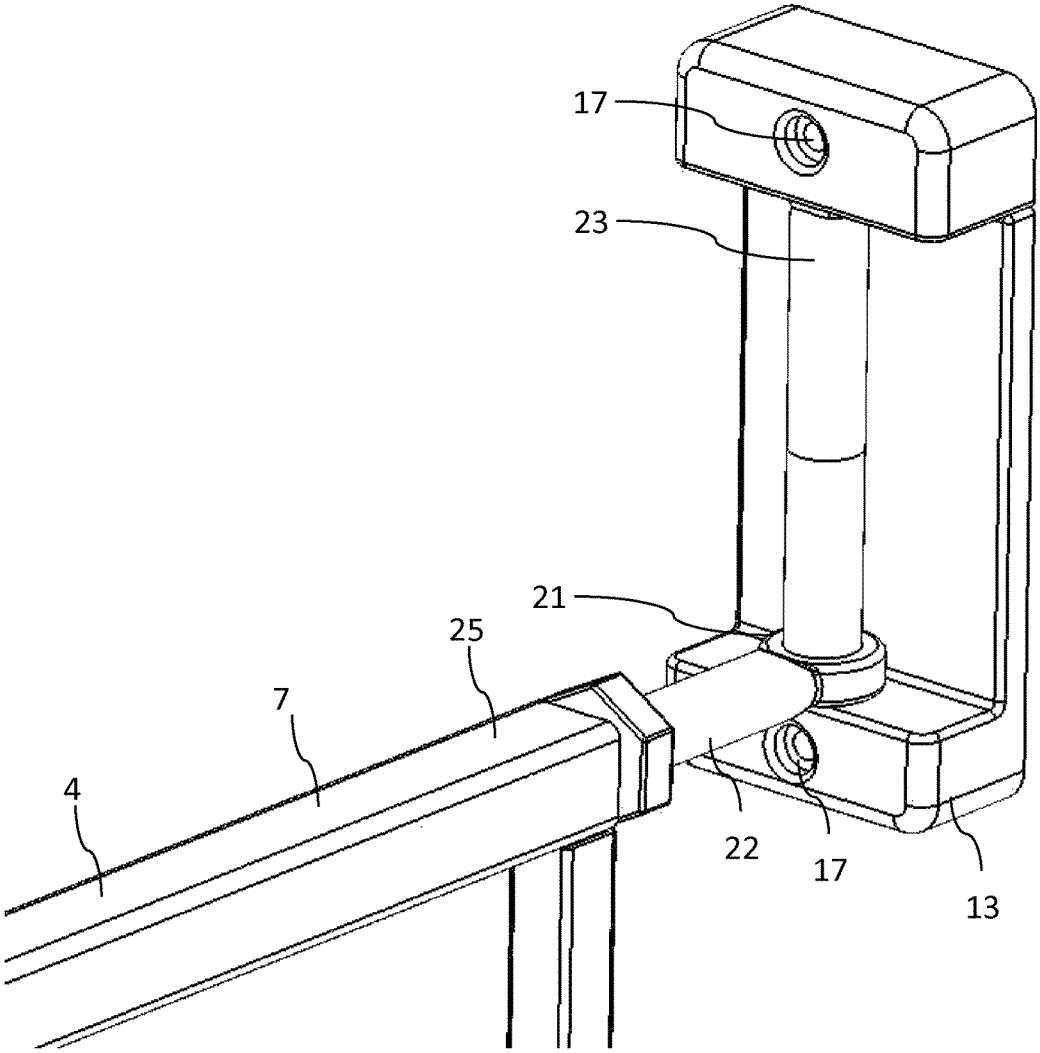
FIG. 6 is an enlarged isometric view of the brace pressure mount connection.
Figure 7:
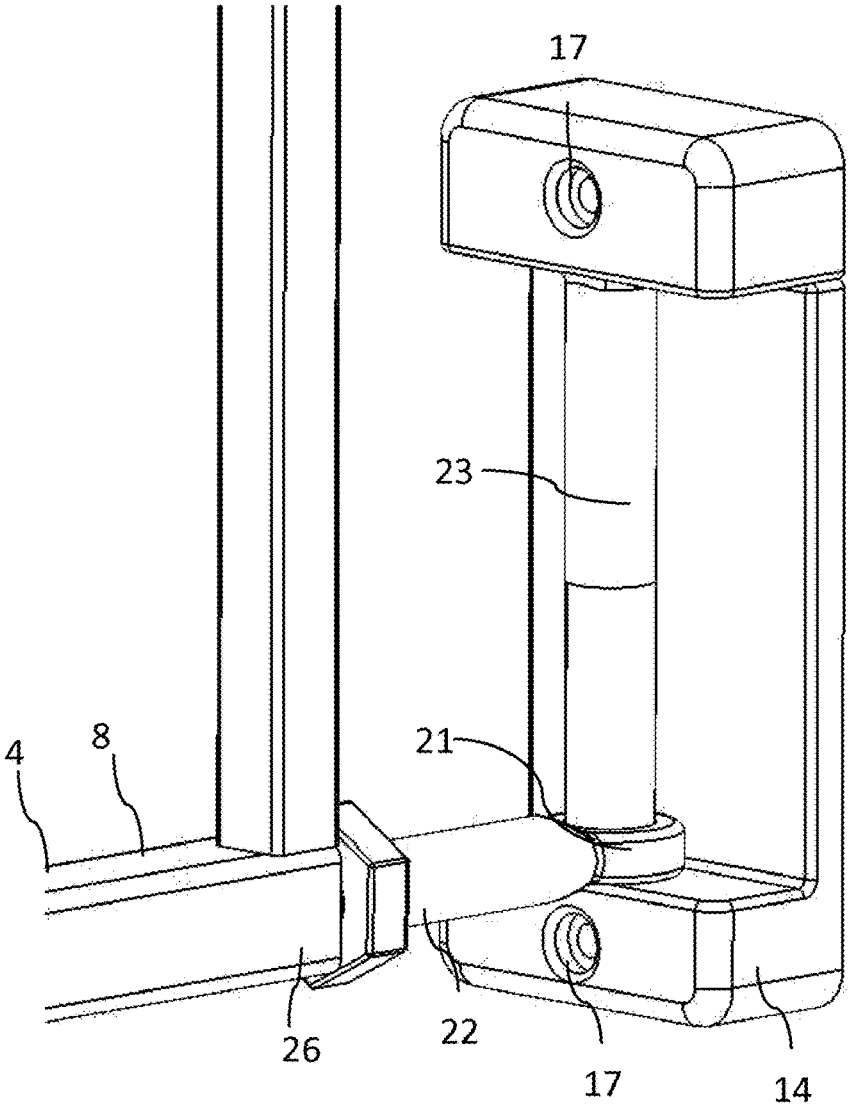
FIG. 7 is an isometric view of the right side top mount connection.
Figure 8:
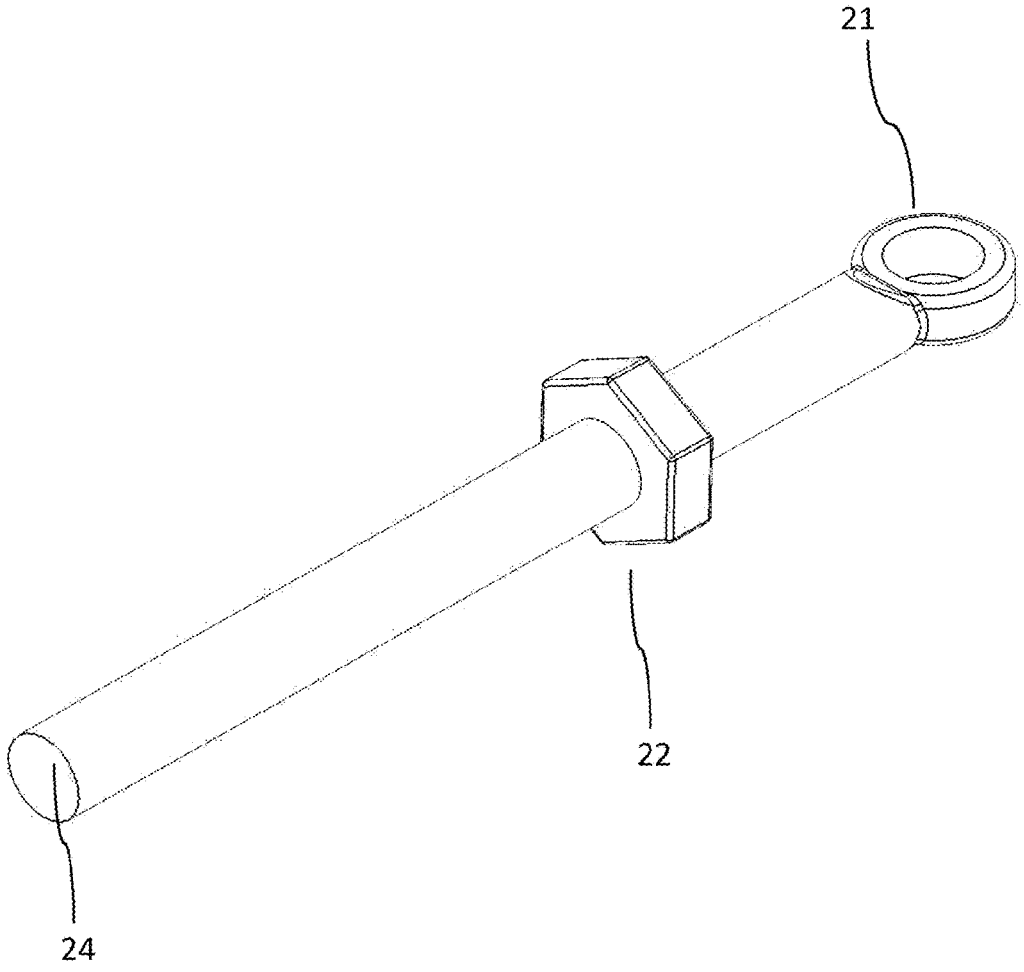
FIG. 8 is an isometric view of the right side bottom mount connection.
Figure 9:
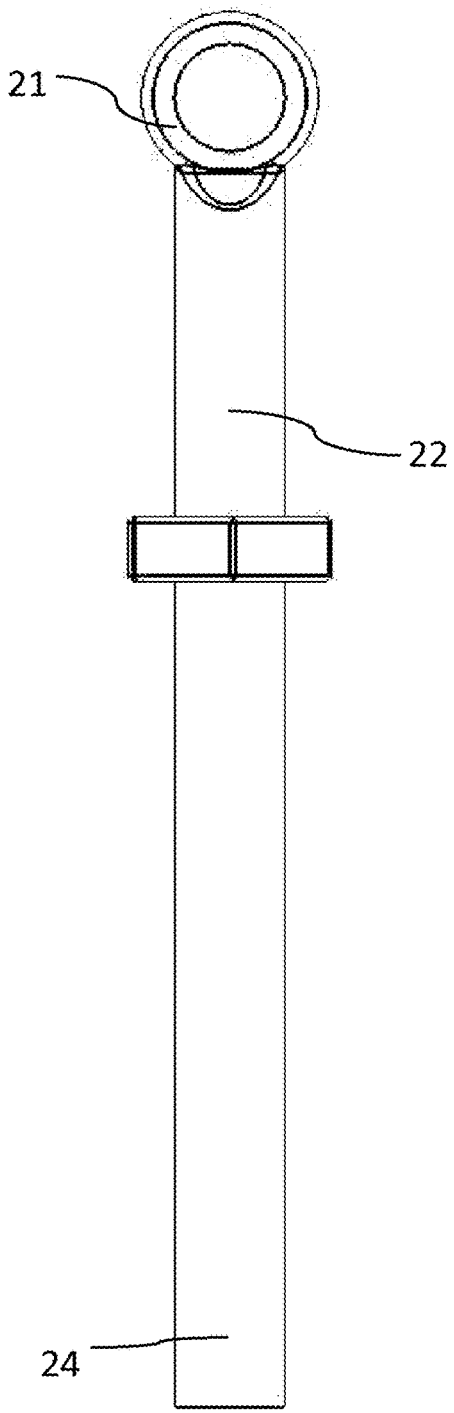
FIG. 9 is an isometric view of the right side attachment ring.
Figure 10:
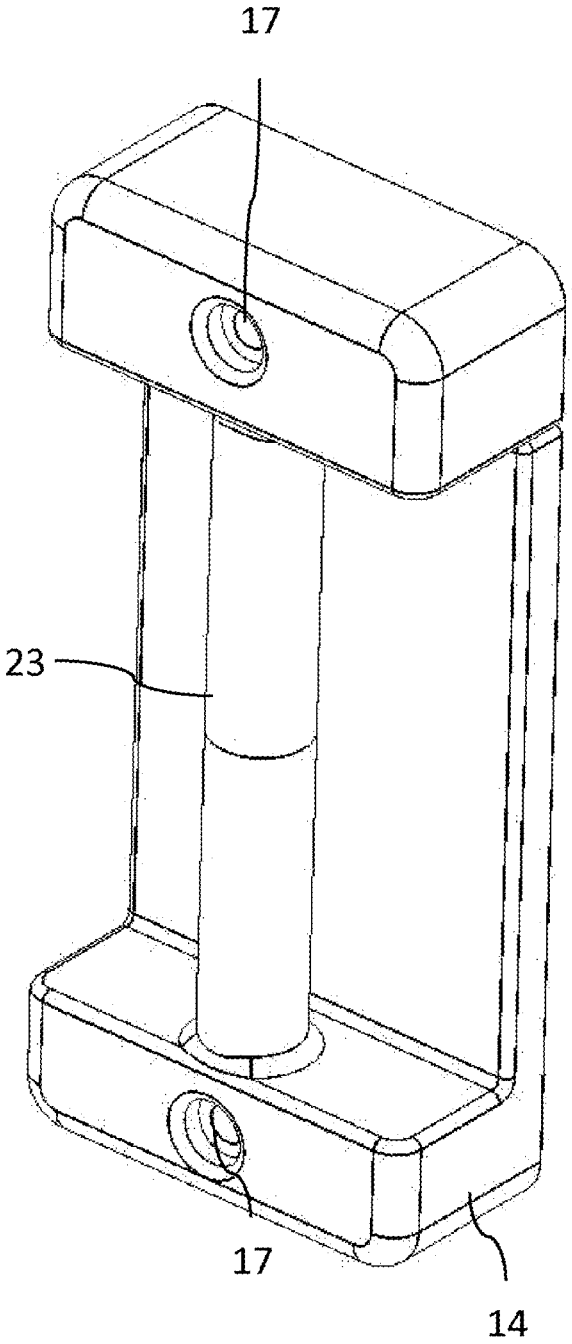
FIG. 10 is a top view of the right side attachment ring.
Figure 11:
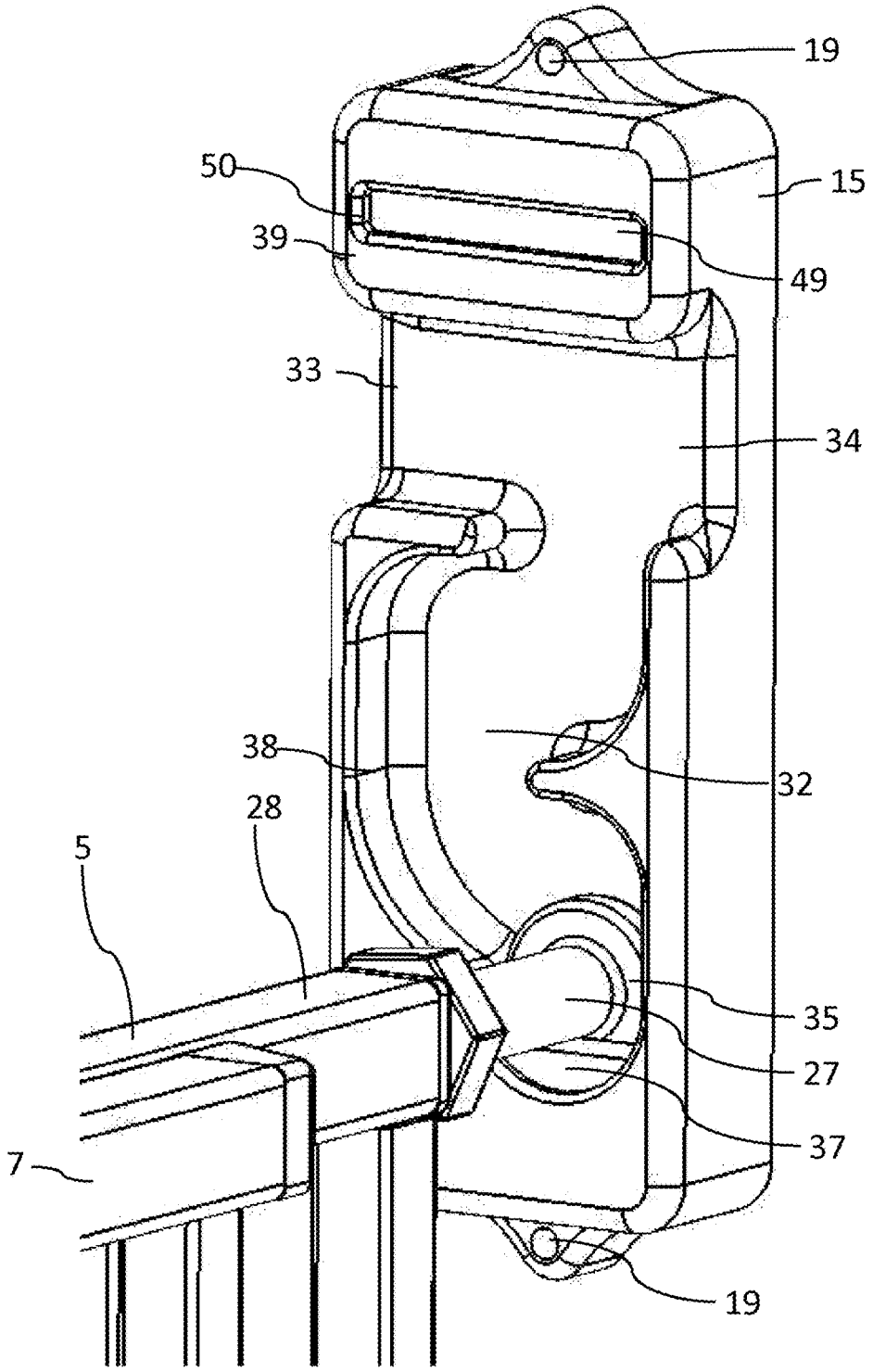
FIG. 11 is an isometric view of the right side ring mount.
Figure 12:
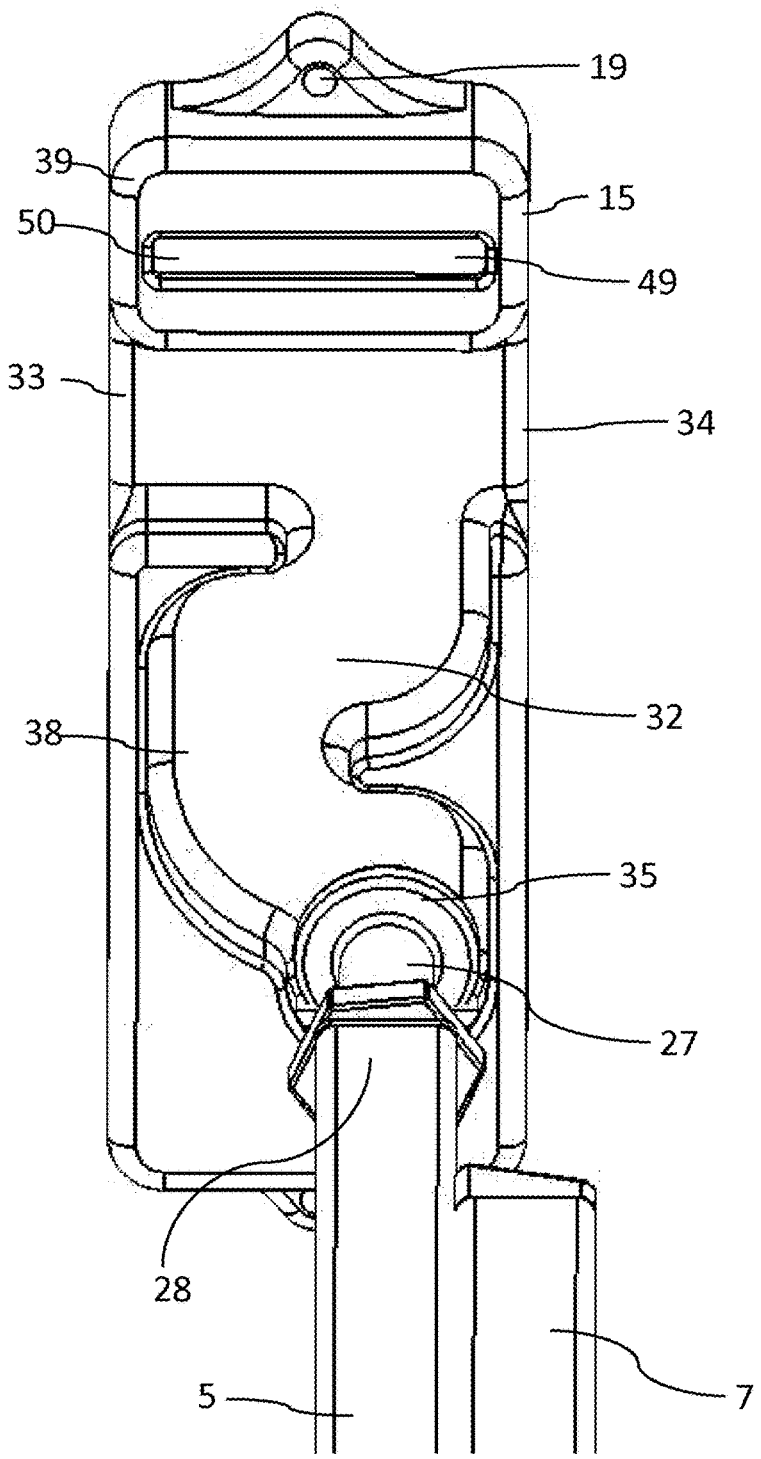
FIG. 12 is an enlarged front view of the brace pressure mount connection.
Figure 13:
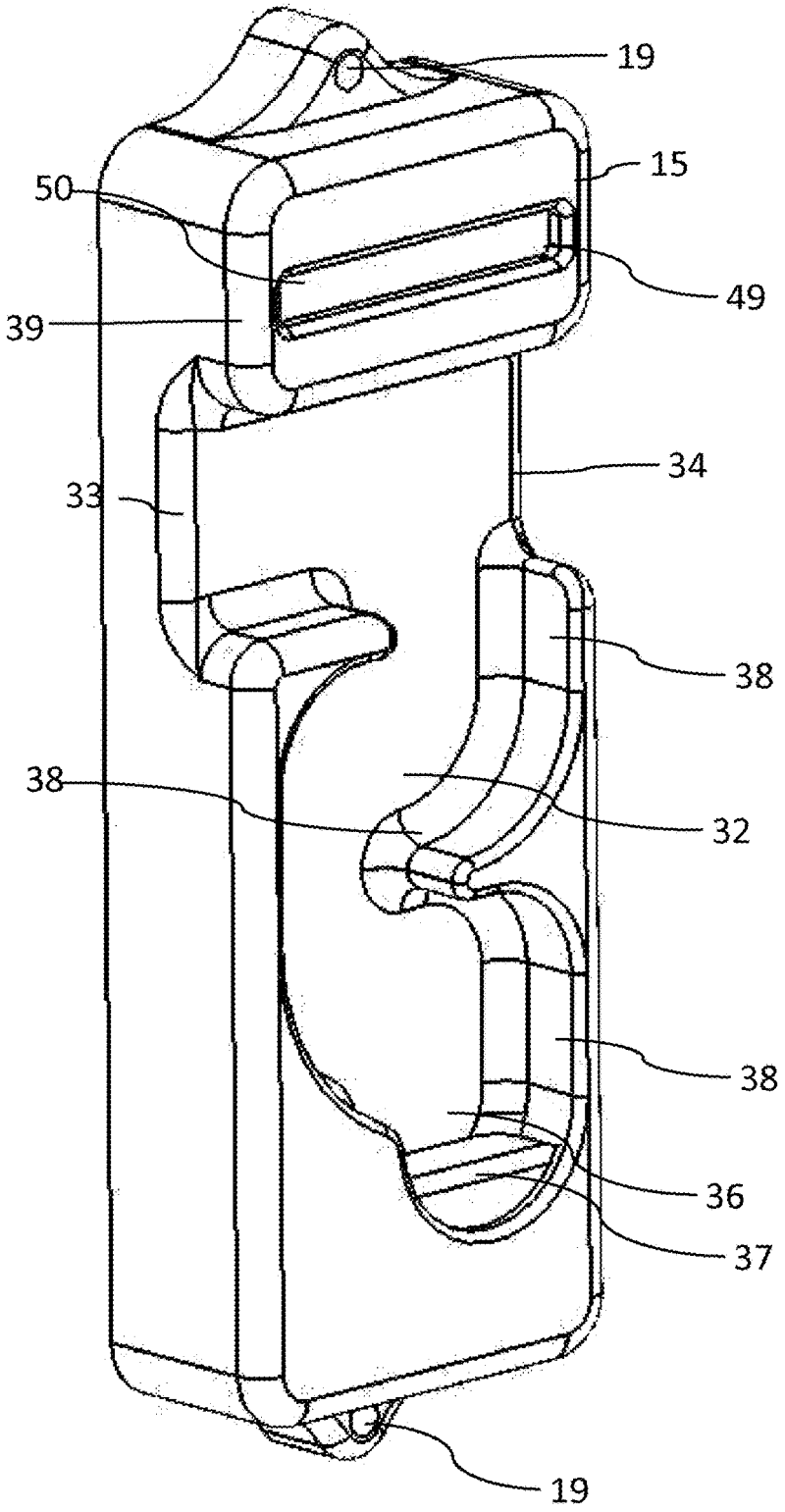
FIG. 13 is an isometric view of the brace.
Figure 14:
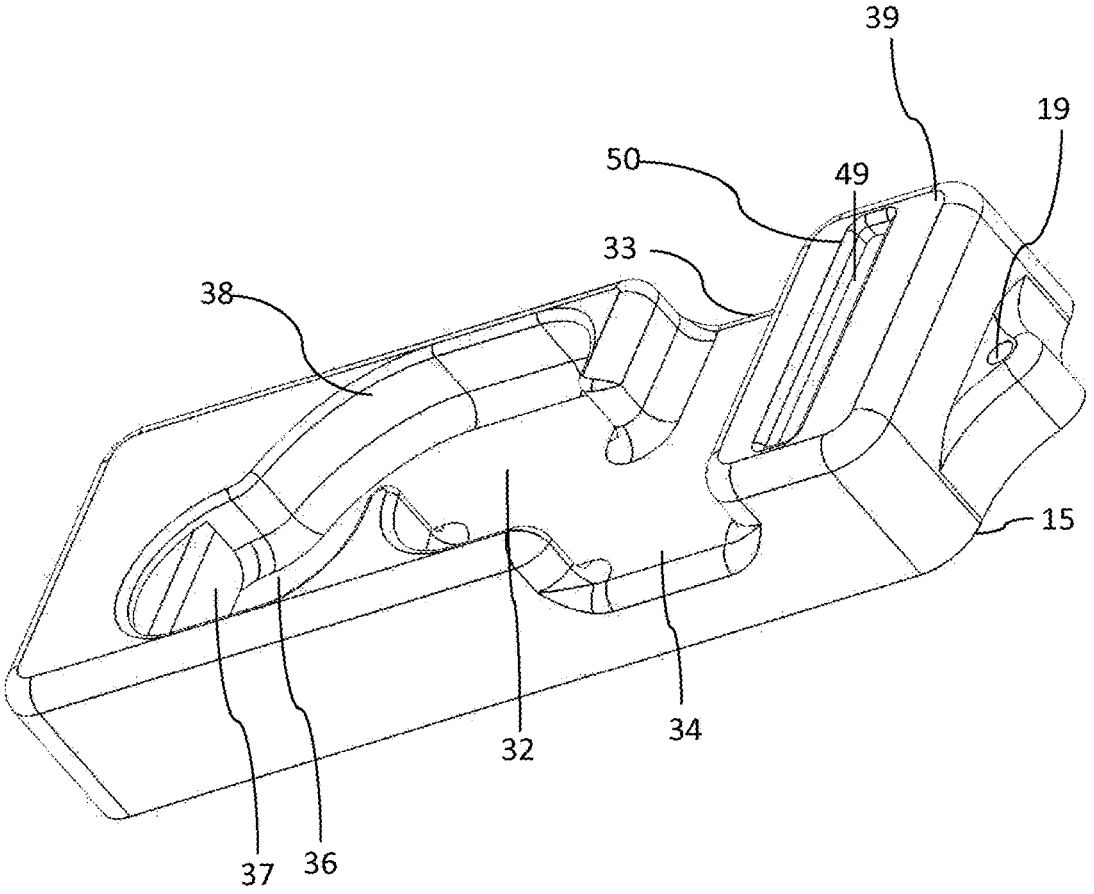
FIG. 14 is another isometric of the brace.
Figure 15:
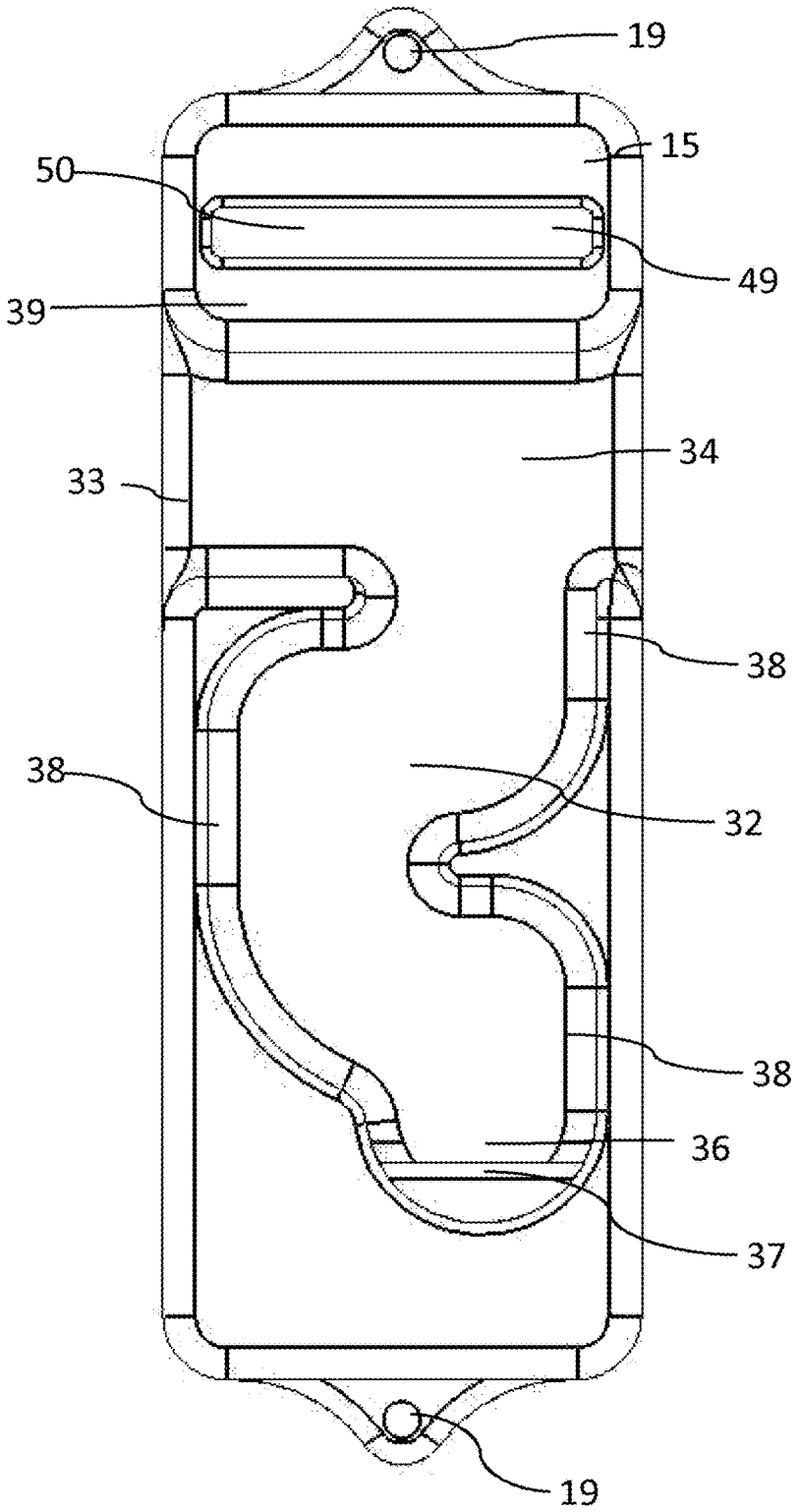
FIG. 15 is a front view of the brace.
Figure 16:
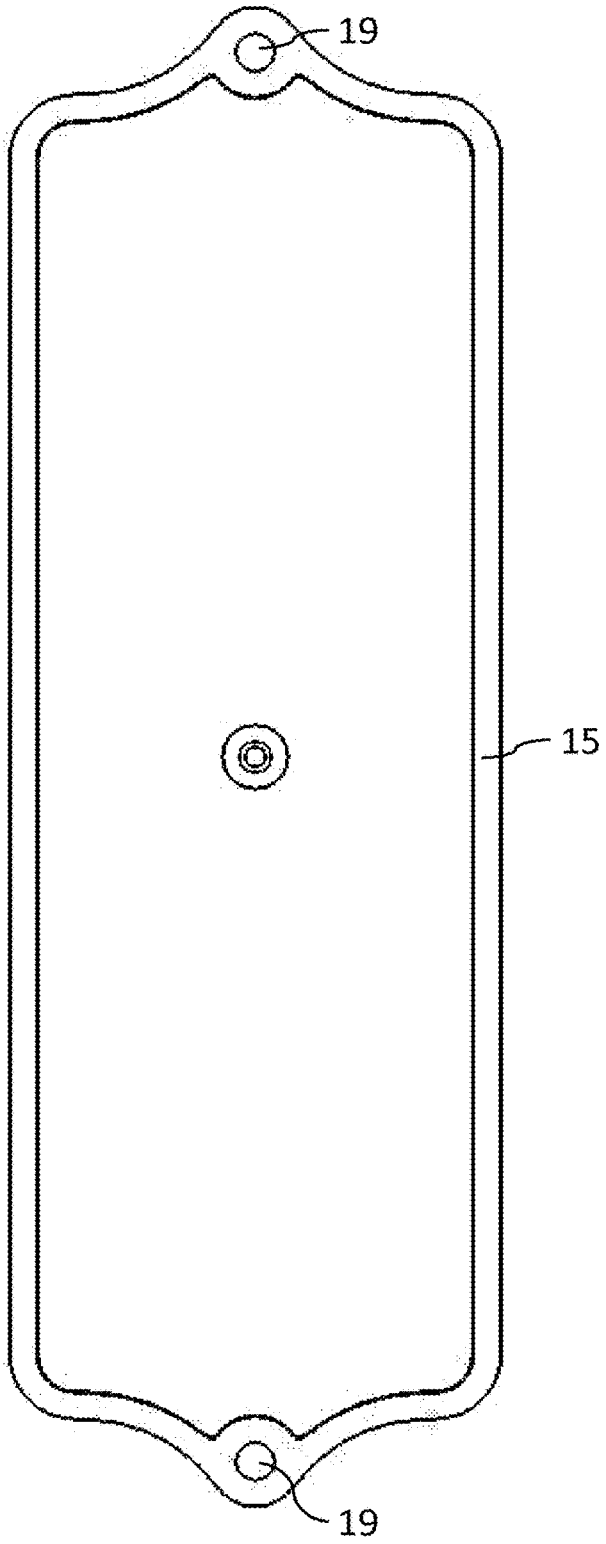
FIG. 16 is a rear view of the brace.
Figure 17:
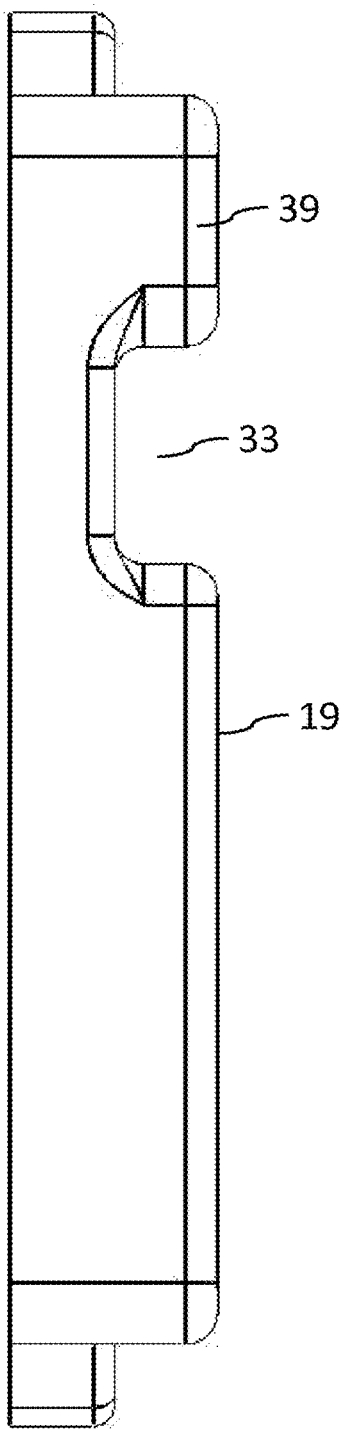
FIG. 17 is a right side view of the brace.
Figure 18:
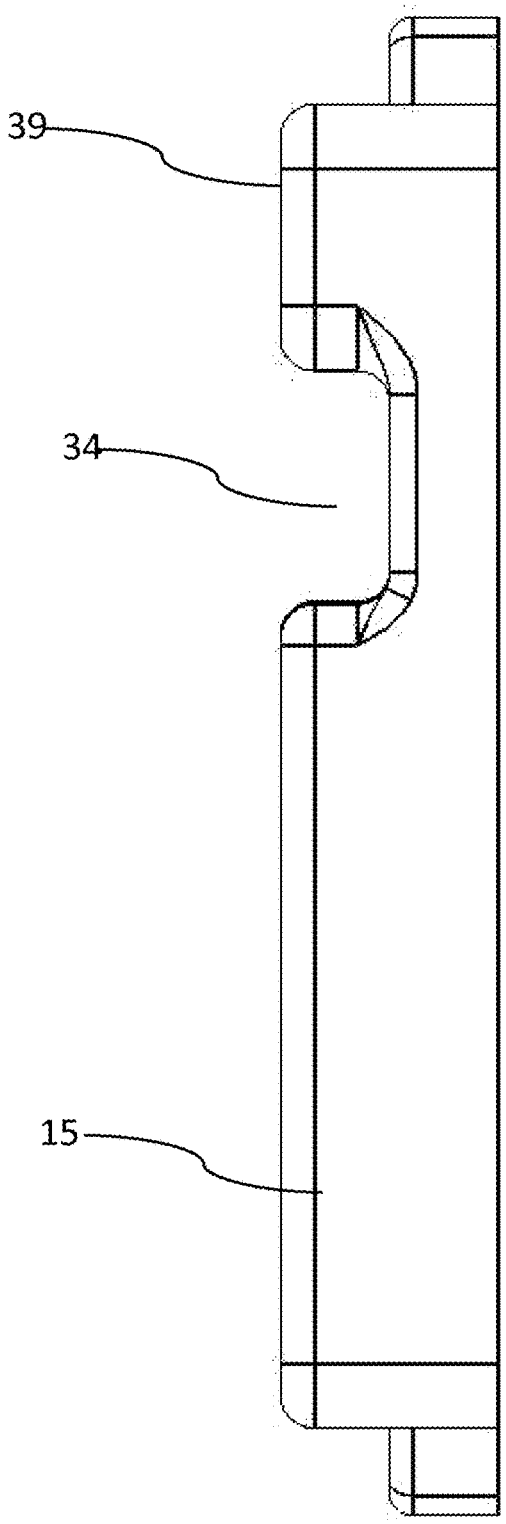
FIG. 18 is a left side view of the brace.
Figure 19:
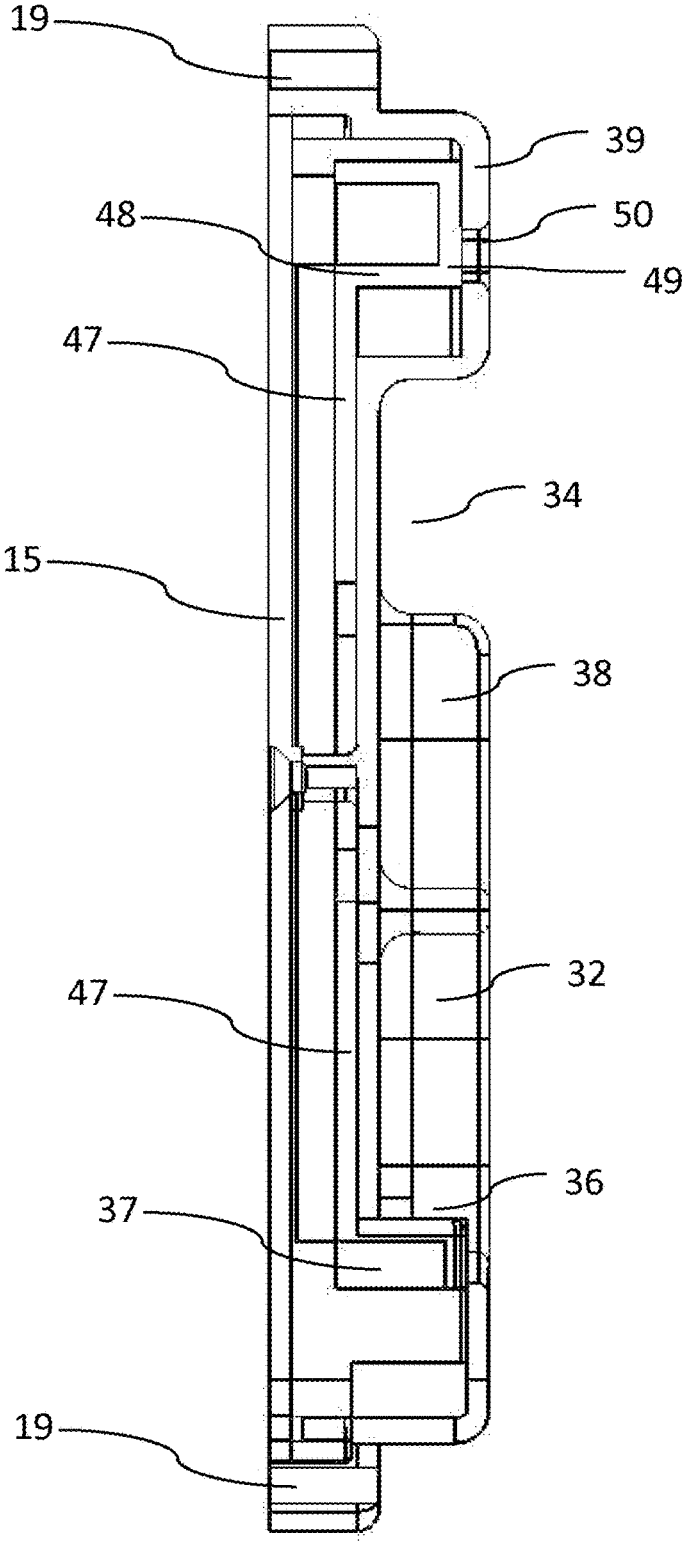
FIG. 19 is a side cross-sectional view of the brace.
Figure 20:
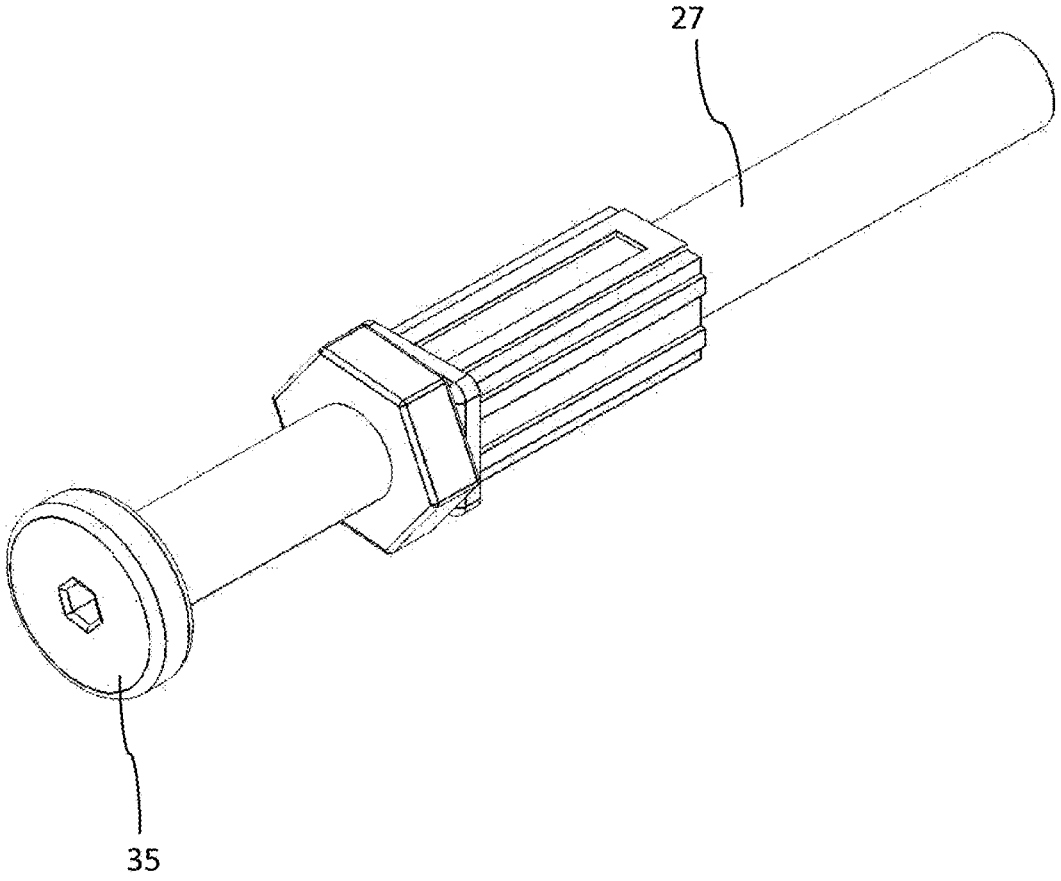
FIG. 20 is an isometric view of the left side pressure mount.
Figure 21:
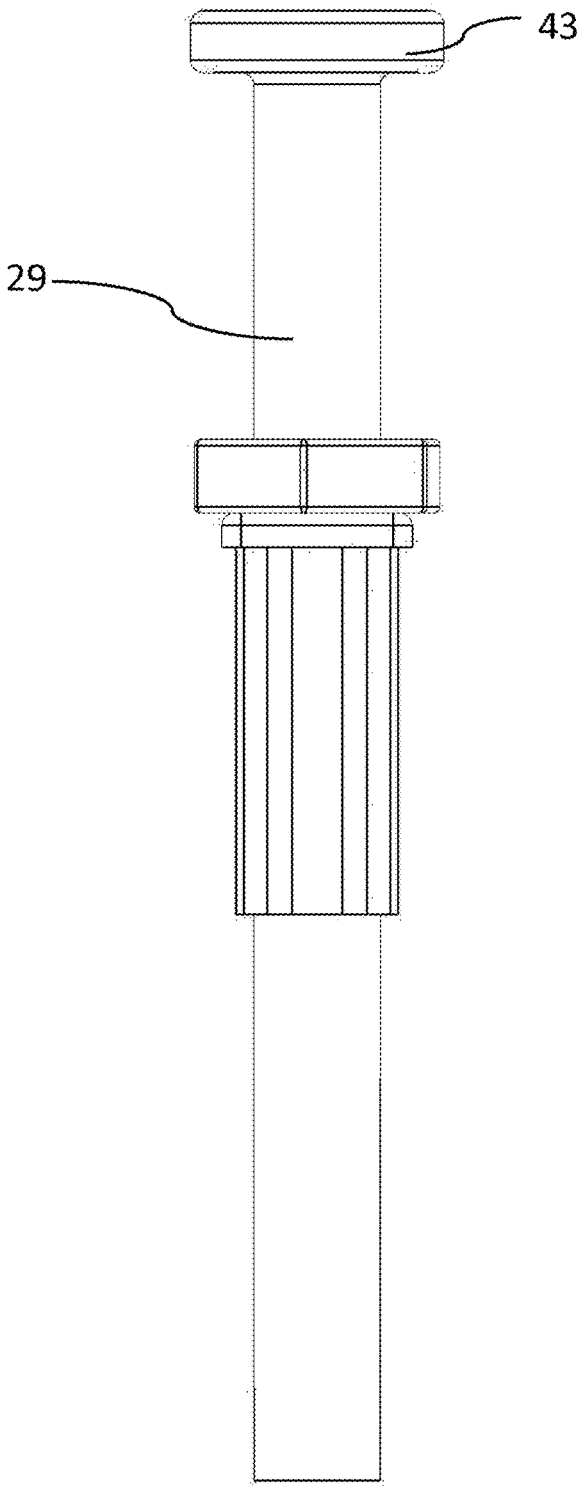
FIG. 21 is a top view of the left side pressure mount.
Figure 22:
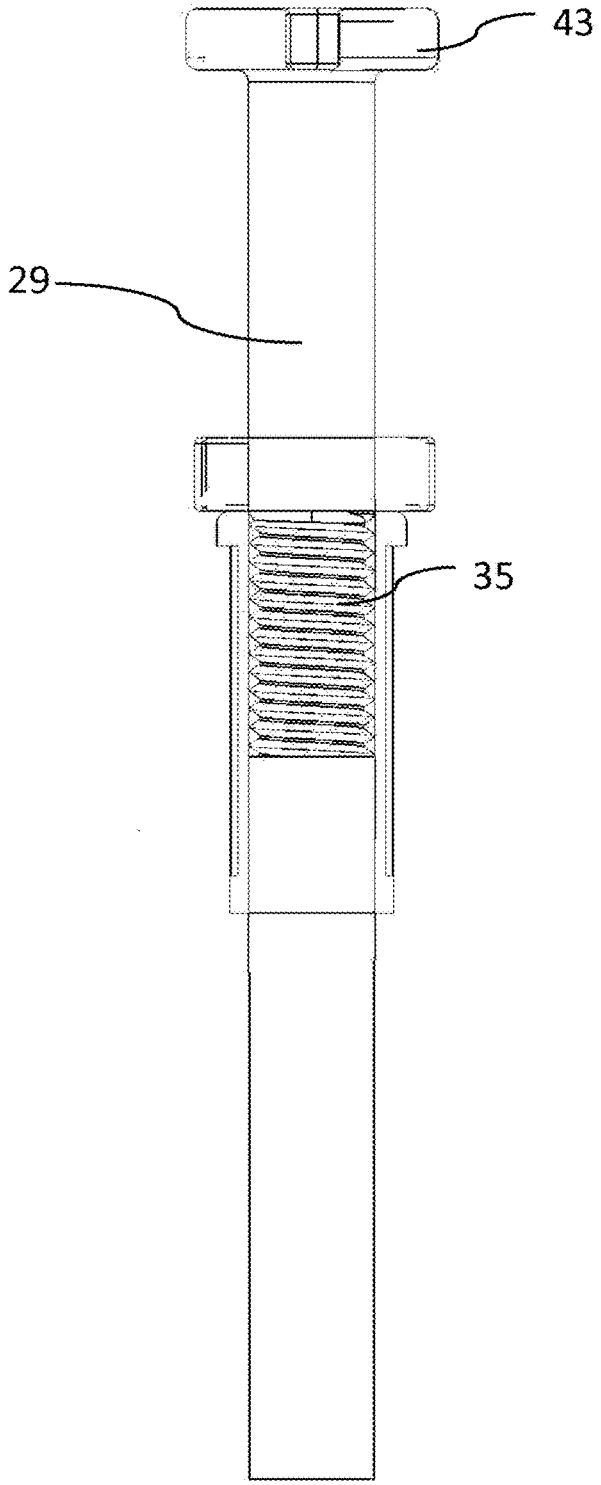
FIG. 22 is a top cross-sectional view of the left side pressure mount.
Figure 23:
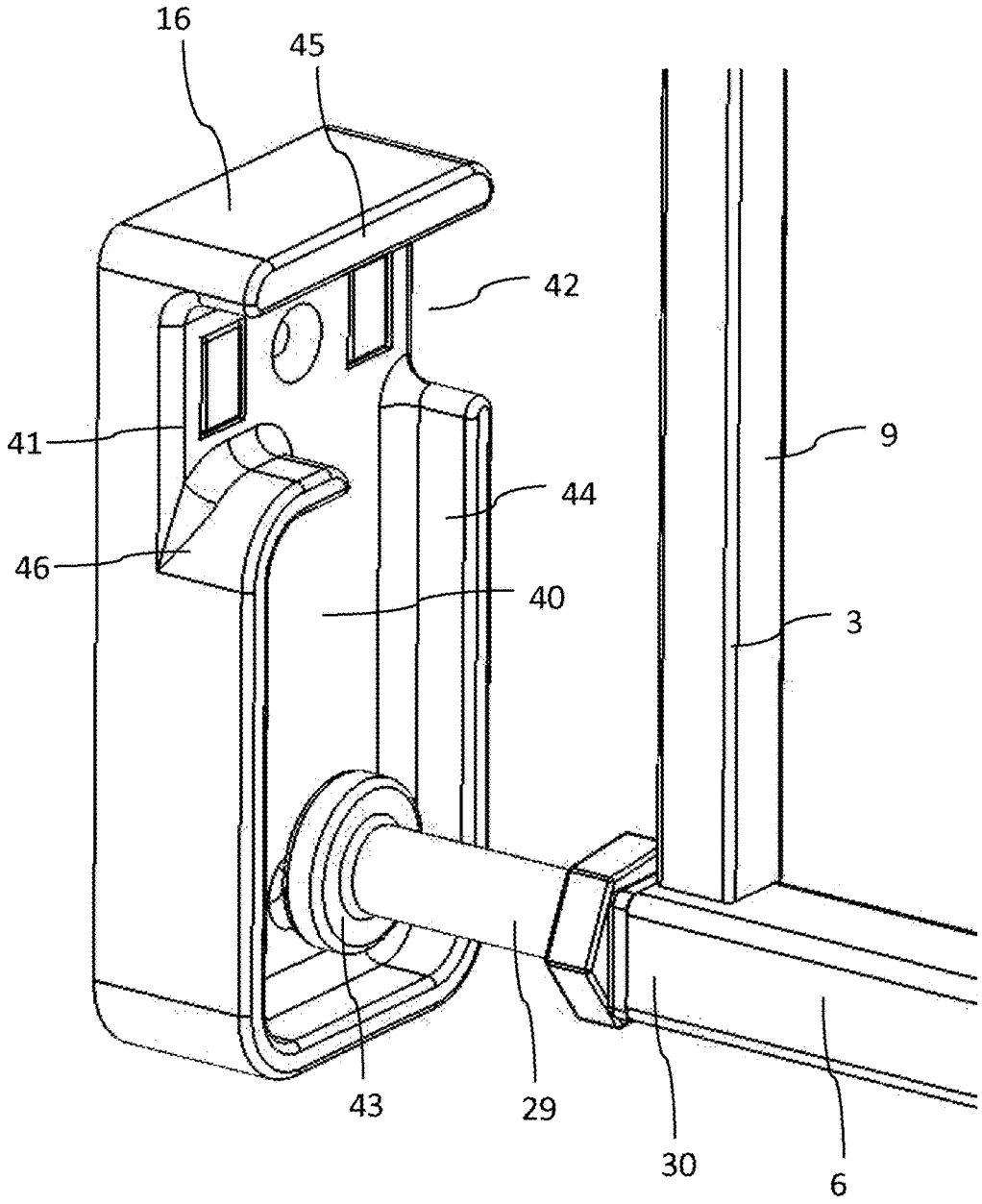
FIG. 23 is an enlarged isometric view of the left bottom brace connection.
Figure 24:
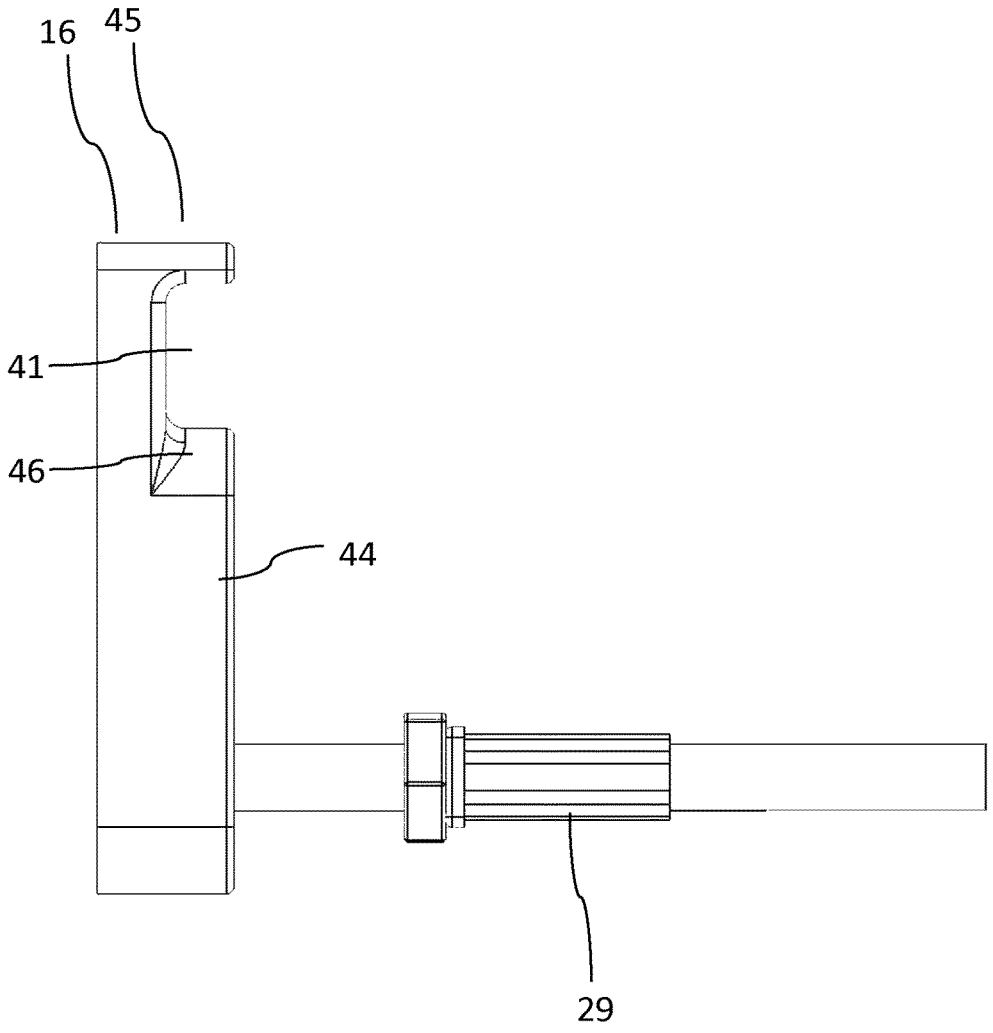
FIG. 24 is a side view of the left bottom brace connection.
Figure 25:
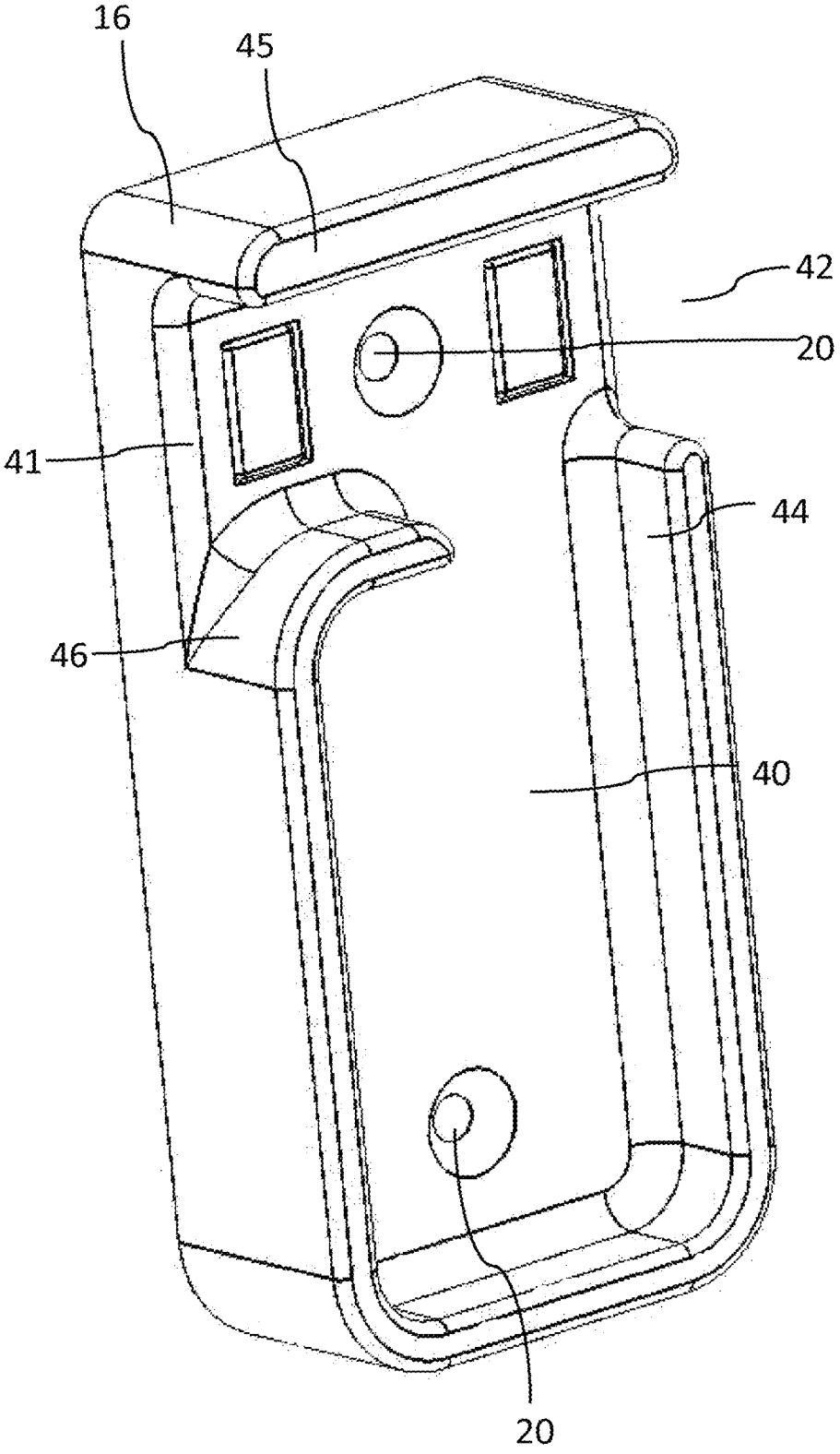
FIG. 25 is an isometric view of the left bottom brace.
Figure 26:
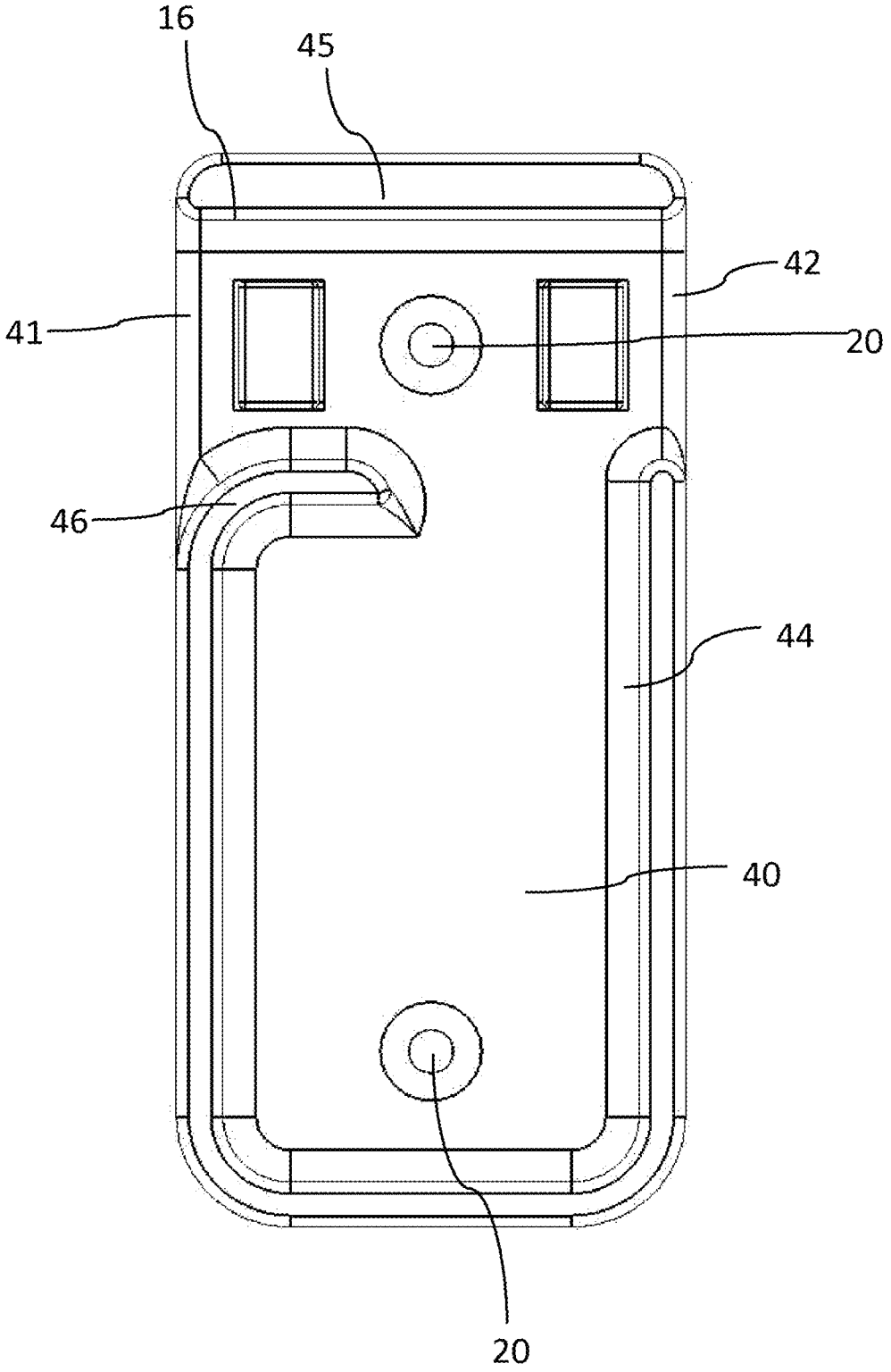
FIG. 26 is a front view of the left bottom brace.
Figure 27:
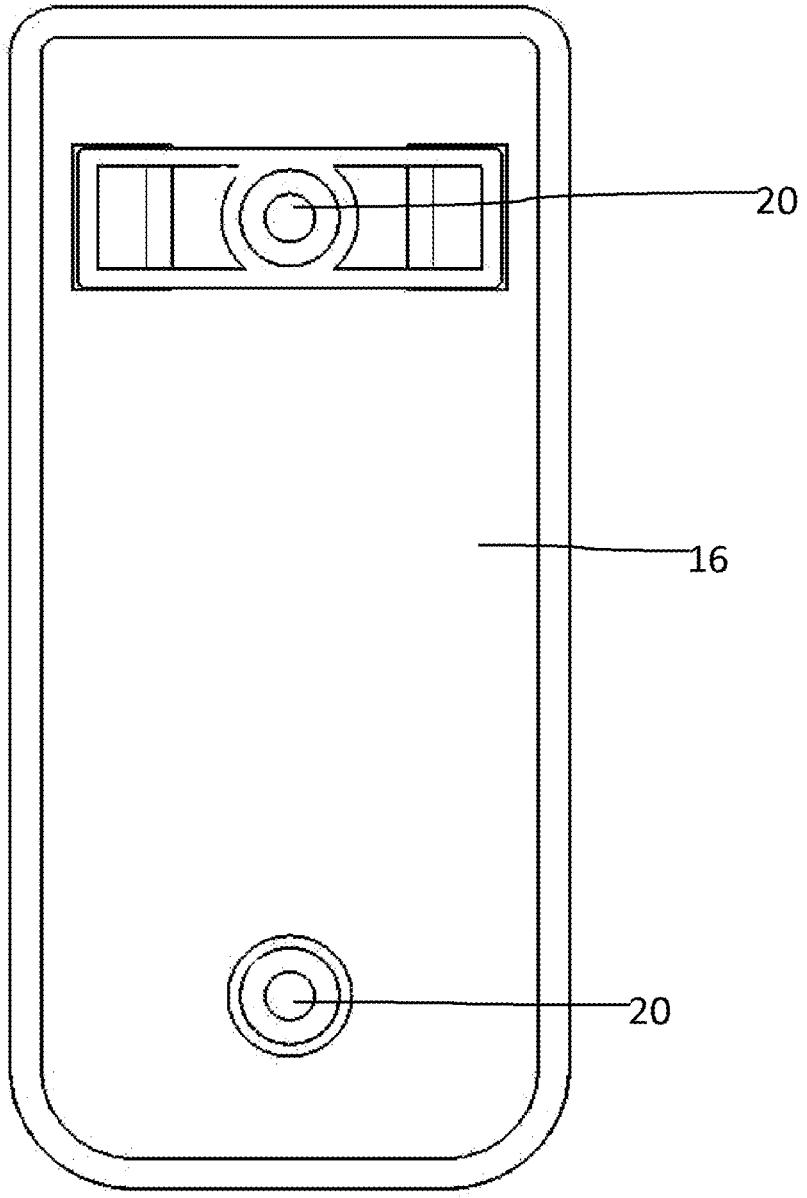
FIG. 27 is a rear view of the left bottom brace.
Figure 28:
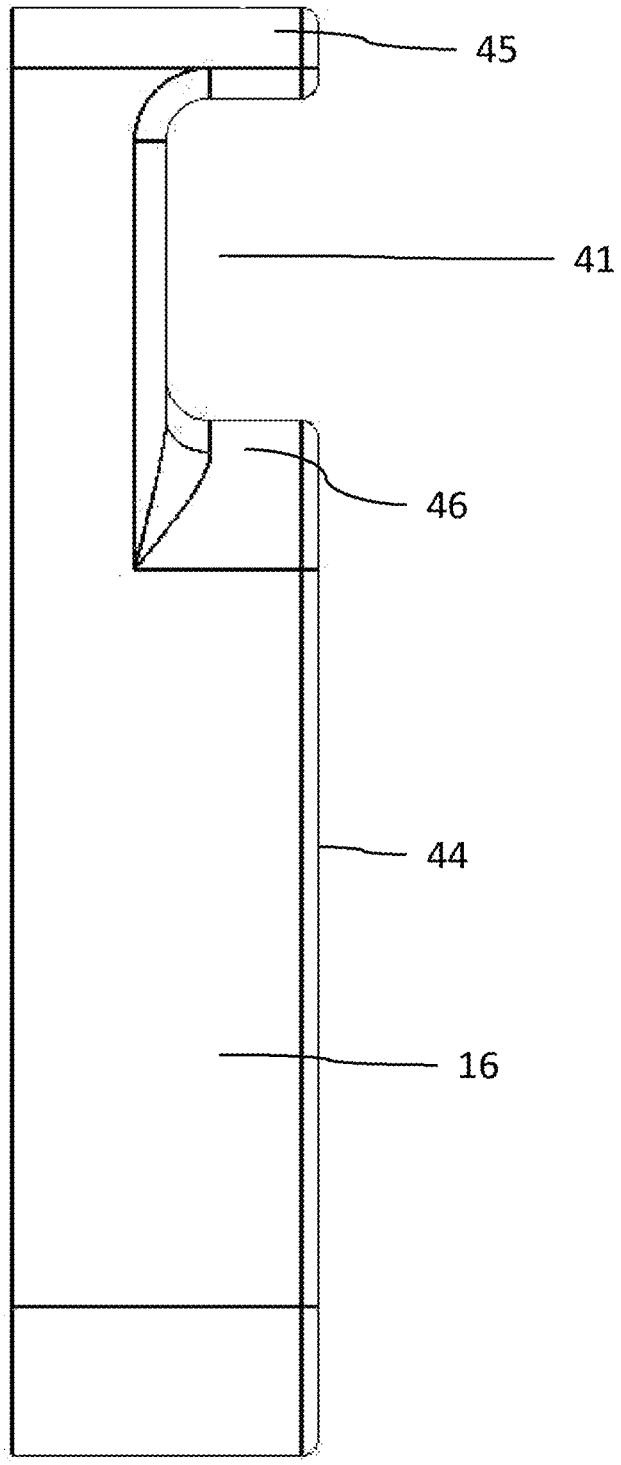
FIG. 28 is a right side view of the left bottom brace.
Figure 29:
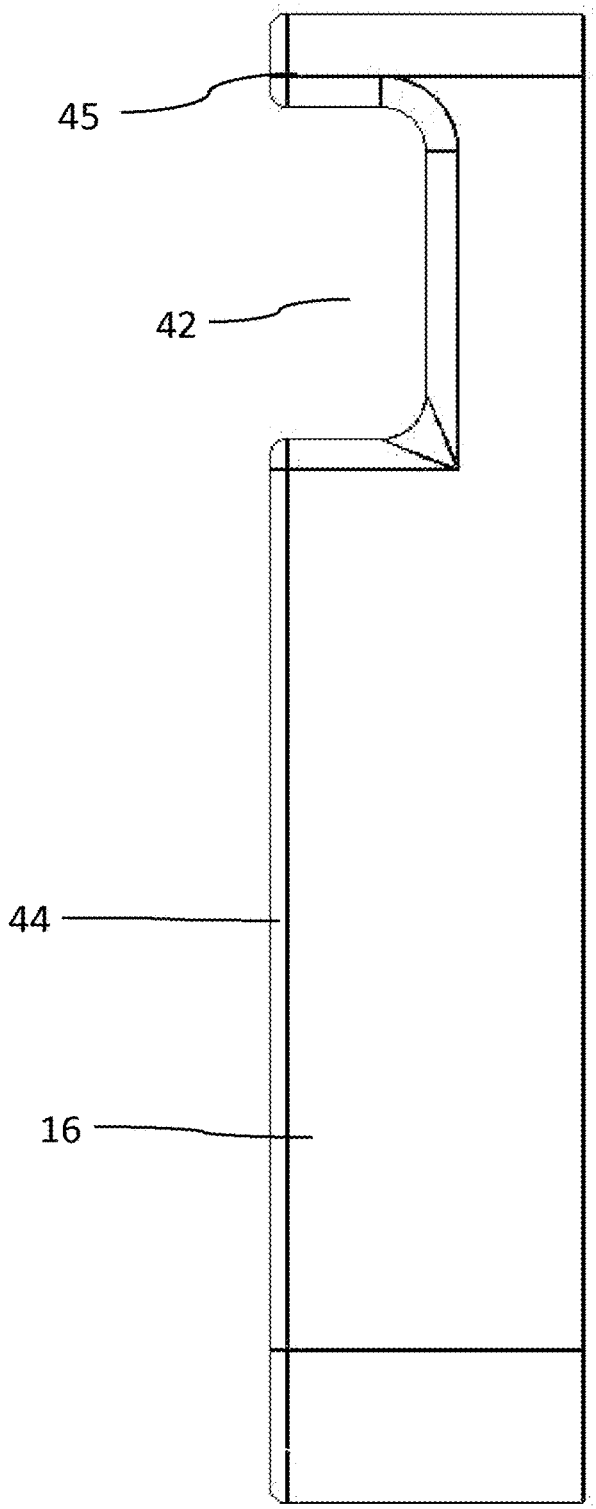
FIG. 29 is a left side view of the left bottom brace.

Aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Embodiments described herein relate to a security gate that includes rounded edges to prevent injury, a curved path for holding the pressure mount to prevent unlocking, and a highly visible, color-coded locked/unlocked status indicator for use in household openings, such as doorways, to provide a barrier for a small child, or for any other suitable use.

The gate assembly 1 comprises a lightweight frame 2 with two panels 3 and 4 that are slidable relative to each other. Panel 3 contains a top member 5 and base member 6. Panel 4 contains a top member 7 and base member 8. Panels 3 and 4 may each contain a plurality of struts 9. Top members 5 and 6 are attached with top bracket 10 and base members 6 and 8 are attached with bottom bracket 11. Panels 3 and 4 may freely slide relative to each other through brackets 9 and 10. Sliding panel 3 in the same direction as panel 4 defines an opening for the gate assembly 1. In the closed position, passage through gate assembly 1 is prevented.

The frame 2 may be positioned within a doorway 12 or wall opening by placing a top side ring mount 13 and a bottom side ring mount 14 along one side of the doorway or entryway frame in a substantially straight configuration with each other. On the opposing side of the doorway frame, a top side brace mount 15 is placed substantially aligned with top side ring mount 13 and a bottom side brace mount 16 is placed substantially aligned with bottom side ring mount 14. In embodiments of the subject invention, top side ring mount 13, bottom side ring mount 14, top side brace mount 15 and bottom side brace mount 16 may be placed in the doorway frame using an adhesive, or with set screws passing through them into the frame. In further embodiments of the present disclosure, top side ring mount 13 has two threaded screw holes 17, bottom side ring mount 14 has two threaded screw holes 18, top side brace mount 15 has two threaded screw holes 19, and bottom side brace mount 16 has two threaded screw holes 20.

Once top side ring mount 13, bottom side ring mount 14, top side brace mount 15 and bottom side brace mount 16 are mounted in the doorway, the ring ends 21 of two side attachment rings 22 are placed around the front cylindrical attachments 23 of the top side ring mount 13 and the bottom side ring mount 14. The other end 24 of each side attachment ring 22 is contained within end 25 of top member 7 and end 26 of base member 8 of panel 4. The front cylindrical attachments 23 allows the attached side attachment rings 22 to move freely up and down with the gate assembly 1 when it is opened or unattached.

A top removable pressure mount 27 is placed within end 28 of top member 5 of panel 3, and a bottom removable pressure mount 29 is placed within end 30 of base member 6 of panel 3. The pressure mounts 27 and 29 are threaded 31 within ends 28 and 30 to allow their lengths to be adjusted.

Top side brace mount 15 contains a maze-like or branching channel 32 with side openings 33 and 34 for receiving the front end 35 of the top pressure mount 27. The end 36 of channel 32 contains a catch 37 for removably holding the front end 35 of top pressure mount 27. Channel 32 has branching sidewalls 38 and a top extended surface 39 that prevents the front end 35, and top pressure mount 27 from being released from the brace mount 15 except through side openings 33 or 34. The branching sidewalls 38 and the top surface 39 create a maze-like through which the top pressure mount 27 must be guided through either side openings 33 or 34 to lock or unlock the gate assembly 1. This prevents small children and other candidates from inadvertently unlocking the gate.

Bottom side brace mount 16 has a wide channel 40 with side openings 41 and 42 for receiving the front end 43 of the bottom pressure mount 29. Channel 40 has sidewalls 44 and a top extending surface 45 that prevent the front end 43 and bottom pressure mount 29 from being released from bottom side brace mount 16 except through side openings 41 or 42. Channel 40 also contains a slightly curved sidewall 46 that prevents small children and other possible candidates from inadvertently unlocking the gate.

Thus, in use, in order to open the gate assembly 1, a user grips top members 5 and 6 of panels 3 and 4, and lifts the pressure mount 27 out of catch 37 through the branches of channel 32, and concurrently lifts pressure mount 29 up through channel 40, and then exits pressure mount 27 through either side opening 33 or 34, and concurrently exits pressure mount 29 through side opening 41 or 42. In use, the gate assembly 1 can be quickly installed, and released with one handed operation from either direction through side openings 33, 34, 41, or 42.

The corners, sidewalls 38, 41, side openings 33, 34, 41, and 42, top extending surfaces 39 and 45, of brace mounts 15 and 16 all possess rounded edges to prevent injury. The corners and the front cylindrical attachments 23 of the top side ring mount 13 and the bottom side ring mount 14 are also rounded to prevent injury. The pressure mounts 27, 29, and the side attachment rings 22 are also rounded to prevent injury.

The gate assembly 1 further includes a visual status indicator that indicates, from a distance, that the gate assembly 1 is locked. The catch 37 of the brace mount 15 is attached to the internal lever 47 that attached to an internal visual indicator 48. The internal visual indicator 48 contains a front surface 49 that comprises two distinct colors, such as red and green. The top extending surface 39 of brace mount 15 contains an opening 50 that substantially aligns with the front surface 49 of the internal visual indicator 48.

In the open position of the gate assembly 1, the color red on the front surface 49 of the internal visual indicator 48 is substantially aligned with opening 50. To a nearby observer, this red color quickly indicates that the gate is unlocked.

As the gate assembly 1 is closed by placing the front end 35 of pressure mount 27 into catch 37, this lowers the internal lever 47, which in turn lowers the internal visual indicator 48 and front surface 49 such that the color green is substantially aligned with opening 50. To a nearby observer, this green color quickly indicates that the gate is locked.

The changing of the colors, from red to green colors indicators to an observer that the gate is locked (green) or unlocked (red) quickly, and from a distance.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A safety gate comprising:

a first panel including a top mount extending from the panel, the top mount having an end;

a first top side brace mount, the first top side brace mount having sidewalls forming a first channel into which the top mount end fits;

wherein the first channel has first and second side openings through which the top mount end can exit, and the first channel forms a path that the top mount end must travel through to reach the first and second side openings, the path requiring the top mount end to travel generally upwardly toward the first and second side openings, and the path requiring the top mount end to travel in a first lateral direction, and then to travel in a second lateral direction opposite to the first lateral direction to reach the first and second openings; and a top extended surface that, with the sidewalls of the first top side brace mount, prevents the top mount end from being released from the top side brace mount except through the first and second side openings of the first channel.

2. A safety gate as in claim 1, wherein the first channel comprises a serpentine channel.

3. A safety gate as in claim 1, wherein the first panel comprises a first bottom mount having an end, the safety gate further comprising:

a bottom side brace mount having a second channel with sidewalls and side openings, the bottom side brace mount also comprising a top extending surface that, with the sidewalls of the bottom side brace mount, prevents the first bottom mount end from being released from the bottom side brace mount except through the side openings of the second channel.

4. A safety gate as in claim 1, wherein the top tope extended surface includes an opening through which a colored surface is visible.

5. A safety gate as in claim 1 wherein the first lateral direction is a lateral component of a first diagonal direction, and the second lateral direction is a lateral component of a second diagonal direction.

6. A safety gate comprising:

a first panel including a top mount extending from the panel, the top mount having an end;

a first top side brace mount, the first top side brace mount having sidewalls forming a channel into which the top mount end fits, wherein a depressible member is positioned within the channel;

a visual status indicator comprising a surface having first and second distinct colors; and the first top side brace mount having an opening through which the surface of the visual status indicator is visible; wherein when the gate is closed by placing the end of the top mount into the first top side brace mount, a vertical downward pressure of the top mount on the depressible member vertically lowers the surface of the visual status indicator such that the first color of the surface is substantially aligned with the opening of the first top side brace mount; and when the gate is in an open position, the second color of the surface is substantially aligned with the opening of the first top side brace mount.

7. A safety gate as in claim 6, wherein the first top side brace mount has a top extending surface, and the opening is in the top extending surface.

8. A safety gate as in claim 7, wherein the channel has first and second side openings, and wherein the top extending surface, with the sidewalls of the first top side brace mount, prevents the top mount end from being released from the top side brace mount except through the first and second side openings of the channel.

9. A safety gate as in claim 6, wherein the channel comprises a serpentine channel.

10. A safety gate as in claim 6, wherein the first color is green, and the second color is red.

11. A safety gate as in claim 6, wherein the depressible member comprises a catch to removably hold the end of the top mount.

12. A safety gate as in claim 6, wherein the channel has first and second side openings through which the top mount end can exit, and the first channel forms a path that the top mount end must travel through to reach the first and second side openings, the path requiring the top mount end to travel generally upwardly toward the first and second side openings, and the path requiring the top mount end to travel in a first lateral direction, and then to travel in a second lateral direction opposite to the first lateral direction to reach the first and second openings; and a top extended surface that, with the sidewalls of the first top side brace mount, prevents the top mount end from being released from the top side brace mount except through the first and second side openings of the first channel.

13. An expandable gate assembly for positioning in an opening, said gate assembly comprising:

two panels slidably mounted to each other via a top bracket and a bottom bracket to allow adjustment of an overall width of the gate assembly to allow fitting of said gate assembly in said opening;

a first set of mounting braces, each comprising a substantially flat rear surface, and a front surface for attaching to two elongated fixed mounting members;

a third mounting brace comprising a front recess enclosed by a sidewall, wherein the sidewall has at least one side opening proximate to the top of the third mounting brace, a first elongated moveable mounting member comprising a first end contained within the second panel, and a second end comprising a substantially flat head extending outwardly from the first elongated moveable mounting member, wherein the flat head fits within the side opening to be contained within the sidewall of the recess;

a fourth mounting brace comprising a front serpentine recess enclosed by a sidewall, wherein the sidewall has at least one side opening proximate to the top of the fourth mounting brace, a second elongated moveable mounting member comprising a first end contained within the second panel, and a second end comprising a substantially flat head extending outwardly from the second elongated moveable mounting member, wherein the flat head fits within the side opening to be contained within the sidewall of the serpentine recess, further wherein an end of the serpentine channel comprises a catch for removably receiving the substantially flat head;

a visual indicator operatively engaged with the catch, wherein the visual indicator permits a nearby observer to view only a first color when the catch is disengaged, further wherein upon engagement of the substantially flat head with the catch, the visual indicator permits the nearby observer to view only a second color.

* * * * *